US007802368B2

(12) United States Patent
Coffin et al.

(10) Patent No.: US 7,802,368 B2
(45) **Date of Patent: *Sep. 28, 2010**

(54) RAZOR ASSEMBLY

(75) Inventors: David C Coffin, Hamden, CT (US); Thomas A Follo, Milford, CT (US); Andrew J Pennella, Milford, CT (US)

(73) Assignee: Eveready Battery Company, Inc., St. Louis, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/326,600

(22) Filed: Dec. 2, 2008

(65) Prior Publication Data

US 2009/0077810 A1 Mar. 26, 2009

Related U.S. Application Data

(62) Division of application No. 10/367,255, filed on Feb. 14, 2003, now Pat. No. 7,266,895.

(60) Provisional application No. 60/375,844, filed on Apr. 24, 2002, provisional application No. 60/405,185, filed on Aug. 21, 2002.

(51) Int. Cl.
*B26B 21/14* (2006.01)
*B26B 21/52* (2006.01)

(52) U.S. Cl. ..... 30/531; 30/50; 30/47; 30/527; 30/529

(58) Field of Classification Search ..... 30/531, 30/50, 53, 526, 527, 532, 351, 47, 41, 483, 30/34.05, 34.2, 51, 63, 338, 538, 123, 41.5, 30/124, 529; 206/208, 228, 477, 352, 354, 206/335, 356; 132/289, 292
See application file for complete search history.

(56) References Cited

U.S. PATENT DOCUMENTS 330,418 A 11/1885 Partridge et al.

(Continued)

FOREIGN PATENT DOCUMENTS

BE 509715 3/1952

(Continued)

OTHER PUBLICATIONS

PCT Search Report for Serial No. PCT/IB03/01144 dated Oct. 29, 2003.

(Continued)

*Primary Examiner*—Ghassem Alie
(74) *Attorney, Agent, or Firm*—Energizer Personal Care, LLC

(57) ABSTRACT

A razor assembly is provided that includes a razor cartridge with one or more razor blades, a shaving aid body, a handle, and a linkage pivotally connected to the handle. The linkage is connected to the razor cartridge and the shaving aid body in a manner such that the razor cartridge and the shaving aid body are moveable relative to the handle. Movement of one of the razor cartridge or the shaving aid body in a first direction causes the other of the razor cartridge or the shaving aid body to move in a second direction substantially opposite the first direction. As a result, the positions of the shaving aid body and the razor cartridge are continuously adjusted to maintain the contact surface of the shaving aid body approximately co-planar with the cutting edges of the razor blades within the razor cartridge.

17 Claims, 16 Drawing Sheets

U.S. PATENT DOCUMENTS

| | | | | |
|---|---|---|---|---|
| 951,036 | A | | 3/1910 | Waterman |
| 1,342,028 | A | | 6/1920 | Nordskog |
| 1,543,387 | A | | 6/1925 | Kawalle |
| 1,744,280 | A | | 1/1930 | Peterson |
| 1,768,307 | A | | 6/1930 | Bleloch et al. |
| 1,836,800 | A | | 12/1931 | Hope |
| 2,183,554 | A | | 12/1939 | Evans |
| 2,614,321 | A | | 10/1952 | Ackerman |
| 2,839,224 | A | | 6/1958 | Lipka |
| 3,378,922 | A | | 4/1968 | Schrader et al. |
| 3,477,127 | A | | 11/1969 | Regan |
| 3,702,026 | A | | 11/1972 | Scholin |
| 3,703,765 | A | | 11/1972 | Perez |
| 3,871,077 | A | | 3/1975 | Nissen et al. |
| 3,895,437 | A | * | 7/1975 | DiBuono ..... 30/537 |
| 3,935,639 | A | | 2/1976 | Terry et al. |
| 3,938,247 | A | | 2/1976 | Carbonell et al. |
| 3,969,817 | A | | 7/1976 | DiBuono |
| 4,074,429 | A | | 2/1978 | Roberts |
| 4,170,821 | A | | 10/1979 | Booth |
| 4,241,500 | A | | 12/1980 | Iten |
| 4,483,068 | A | | 11/1984 | Clifford |
| 4,562,644 | A | | 1/1986 | Hitchens |
| 4,587,729 | A | | 5/1986 | Jacobson |
| 4,595,124 | A | | 6/1986 | Duval et al. |
| 4,712,300 | A | | 12/1987 | Hemmeter |
| 4,778,640 | A | | 10/1988 | Braun et al. |
| 4,780,959 | A | * | 11/1988 | Sinka ..... 30/83 |
| 4,850,106 | A | | 7/1989 | Braun et al. |
| 4,893,641 | A | | 1/1990 | Strickland |
| 4,944,090 | A | | 7/1990 | Sumnall |
| 4,964,214 | A | | 10/1990 | Welsh et al. |
| 4,970,784 | A | | 11/1990 | Althaus et al. |
| 4,977,670 | A | | 12/1990 | Iten |
| 4,979,298 | A | | 12/1990 | Pesiri |
| 4,984,365 | A | | 1/1991 | Leonard |
| 5,031,318 | A | | 7/1991 | Brown et al. |
| 5,036,587 | A | | 8/1991 | Trotta et al. |
| 5,056,222 | A | | 10/1991 | Miller et al. |
| 5,063,667 | A | | 11/1991 | Jacobson |
| 5,079,839 | A | | 1/1992 | Conrad, Jr. et al. |
| 5,121,541 | A | | 6/1992 | Patrakis |
| 5,134,775 | A | | 8/1992 | Althaus et al. |
| 5,141,349 | A | | 8/1992 | Maguire, Jr. et al. |
| 5,313,406 | A | | 5/1994 | Kauppinen et al. |
| 5,313,706 | A | | 5/1994 | Motta et al. |
| 5,319,852 | A | | 6/1994 | Metzger |
| 5,347,714 | A | | 9/1994 | Prochaska |
| 5,461,782 | A | | 10/1995 | Rauch |
| 5,463,813 | A | | 11/1995 | Otsuka et al. |
| 5,490,329 | A | | 2/1996 | Chylinski et al. |
| 5,493,778 | A | | 2/1996 | Ichivanaoi |
| 5,517,760 | A | | 5/1996 | Prochaska |
| 5,579,580 | A | | 12/1996 | Althaus et al. |
| 5,604,983 | A | | 2/1997 | Simms et al. |
| 5,626,154 | A | | 5/1997 | Rogers et al. |
| 5,711,076 | A | | 1/1998 | Yin et al. |
| 5,933,960 | A | | 8/1999 | Avidor |
| 5,953,825 | A | | 9/1999 | Christman et al. |
| 5,956,849 | A | | 9/1999 | Chadwick et al. |
| D416,108 | S | | 11/1999 | Shurtleff et al. |
| 6,052,905 | A | | 4/2000 | Branchinelli et al. |
| 6,161,287 | A | | 12/2000 | Swanson et al. |
| 6,185,823 | B1 | | 2/2001 | Brown et al. |
| 6,442,850 | B1 | | 9/2002 | Coffin |
| 6,584,690 | B2 | | 7/2003 | Orloff et al. |
| 2002/0116832 | A1 | | 8/2002 | Coffin |
| 2003/0014871 | A1 | | 1/2003 | Coffin |
| 2005/0166403 | A1 | | 8/2005 | Orloff et al. |
| 2005/0193572 | A1 | | 9/2005 | Gilder |

FOREIGN PATENT DOCUMENTS

| | | | |
|---|---|---|---|
| DE | 319832 | | 2/1919 |
| DE | G 8717729.3 | | 9/1989 |
| EP | 0276066 | | 1/1988 |
| EP | 0477132 | B1 | 3/1992 |
| EP | 0453906 | B1 | 11/1992 |
| EP | 1125697 | | 8/2001 |
| FR | 482302 | | 3/1917 |
| FR | 806899 | | 12/1936 |
| FR | 1484360 | | 6/1967 |
| FR | 1503887 | | 12/1967 |
| FR | 2632886 | * | 12/1989 |
| GB | 409902 | | 5/1934 |
| GB | 1432182 | | 4/1976 |
| GB | 1572442 | | 7/1980 |
| GB | 2042959 | A | 10/1980 |
| GB | 2116470 | | 9/1983 |
| JP | 4-361783 | | 12/1992 |
| WO | WO91/01204 | | 2/1991 |
| WO | WO96/02369 | | 2/1996 |
| WO | 98/36878 | | 8/1998 |

OTHER PUBLICATIONS

European Search Report EP O 1300318 dated May 23, 2001.

* cited by examiner

RAZOR ASSEMBLY

CROSS REFERENCE TO RELATED APPLICATIONS

This application is a division of U.S. patent application Ser. No. 10/367,255 filed Feb. 14, 2003, now U.S. Pat. No. 7,266,895, which claims the benefit of Provisional Patent application Ser. No. 60/375,844, filed Apr. 24, 2002 and Provisional Patent application Ser. No. 60/405,185 filed Aug. 21, 2002.

BACKGROUND OF THE INVENTION

1. Technical Field

This invention relates to shaving devices in general, and to shaving devices that include a shaving aid in addition to one or more razor blades in particular, and replacement cartridges operable therewith.

2. Background Information

Modern safety razors include a plurality of razor blades disposed within a cartridge that is pivotally or rigidly mounted on a handle. Each of the razor blades has a cutting edge that is contiguous with a shave plane. Some safety razors (also referred to hereinafter as razor assemblies) have a disposable cartridge for use with a reusable handle, while others have a handle and cartridge that are combined into a unitary disposable. Razor cartridges often include a strip comprised of shaving aids (e.g., lubricating agents, drag reducing agents, depilatory agents, cleaning agents, medicinal agents, skin conditioning assets, etc.) disposed aft of the razor blades to enhance the shaving process. The terms "forward" and "aft", as used herein, define relative position between features of the safety razor. A feature "forward" of the razor blades, for example, is positioned so that the surface to be shaved encounters the feature before it encounters the razor blades, if the razor assembly is being stroked in its intended cutting direction (e.g., a guard is typically disposed forward of the razor blades). A feature "aft" of the razor blades is positioned so that the surface to be shaved encounters the feature after it encounters the razor blades, if the razor assembly is being stroked in its intended cutting direction (e.g., the aforesaid shaving aid strip disposed aft of the razor blades).

Most safety razors are designed for use with a shaving preparation. The shaving preparation (e.g., shaving cream) is applied to the skin and remains there until it is removed during the shaving process, or washed off thereafter. Although shaving preparations desirably enhance the shaving process, they also have undesirable aspects. For example, shaving cream is impractical in a wet shaving environment because the shaving cream is often washed away before the shaving process can be completed. In addition, shaving cream is an item independent of the razor that must be purchased and stored by the user; i.e., one more item to store in the bathroom.

What is needed, therefore, is a razor assembly that can be used with a shaving preparation without the above-identified problems, and one that can be used in a shower/wet environment.

DISCLOSURE OF THE INVENTION

It is, therefore, an object of the present invention to provide a razor cartridge that includes a shaving preparation, and one that can be used in a shower/wet environment.

According to the present invention, a razor assembly is provided that includes a razor cartridge that includes one or more razor blades, a shaving aid body, a handle, and a linkage.

The linkage is directly or indirectly connected to the razor cartridge and the shaving aid body in a manner that allows the razor cartridge and the shaving aid body to move relative to the handle. Movement of one of the razor cartridge or the shaving aid body in a first direction causes the other of the razor cartridge or the shaving aid body to move in a second direction substantially opposite the first direction. As a result, the shaving plane of the razor cartridge and the contact surface of the shaving aid body positionally self-adjust so that they may remain substantially co-planar.

According to an aspect of the present invention, a replacement cartridge is provided for use with the razor assembly.

An advantage of the present invention is the ease of use and safety provided by the positional self-adjustment of the shaving aid body and the razor cartridge provided by the present invention. The linkage of the present invention, and the self-adjusting movement it provides, enables the relative positions of the shaving aid body and the razor cartridge to be continuously adjusted so that a desirable orientation between the contact surface of the shaving aid body and the cutting edges of the razor blades within the razor cartridge can be maintained automatically during the shaving process. The linkage is connected directly or indirectly to the razor cartridge and to the shaving aid body in such a manner that movement of one of the razor cartridge or the shaving aid body in a first direction causes the other of the razor cartridge or the shaving aid body to move in a second direction substantially opposite the first direction. A change in the height of the shaving aid body (and therefore the position Another advantage of the present invention is that a shaving aid can be applied during the shaving process. As a result, the shaving aid within the shaving aid body can be successfully applied and utilized within a wet shaving environment. The need for an independent source of shaving cream or other shaving preparation, and the clutter and mess associated therewith, is consequently eliminated.

These and other objects, features, and advantages of the present invention will become apparent in light of the detailed description of the present invention.

DETAILED DESCRIPTION OF THE INVENTION

Figure 1:
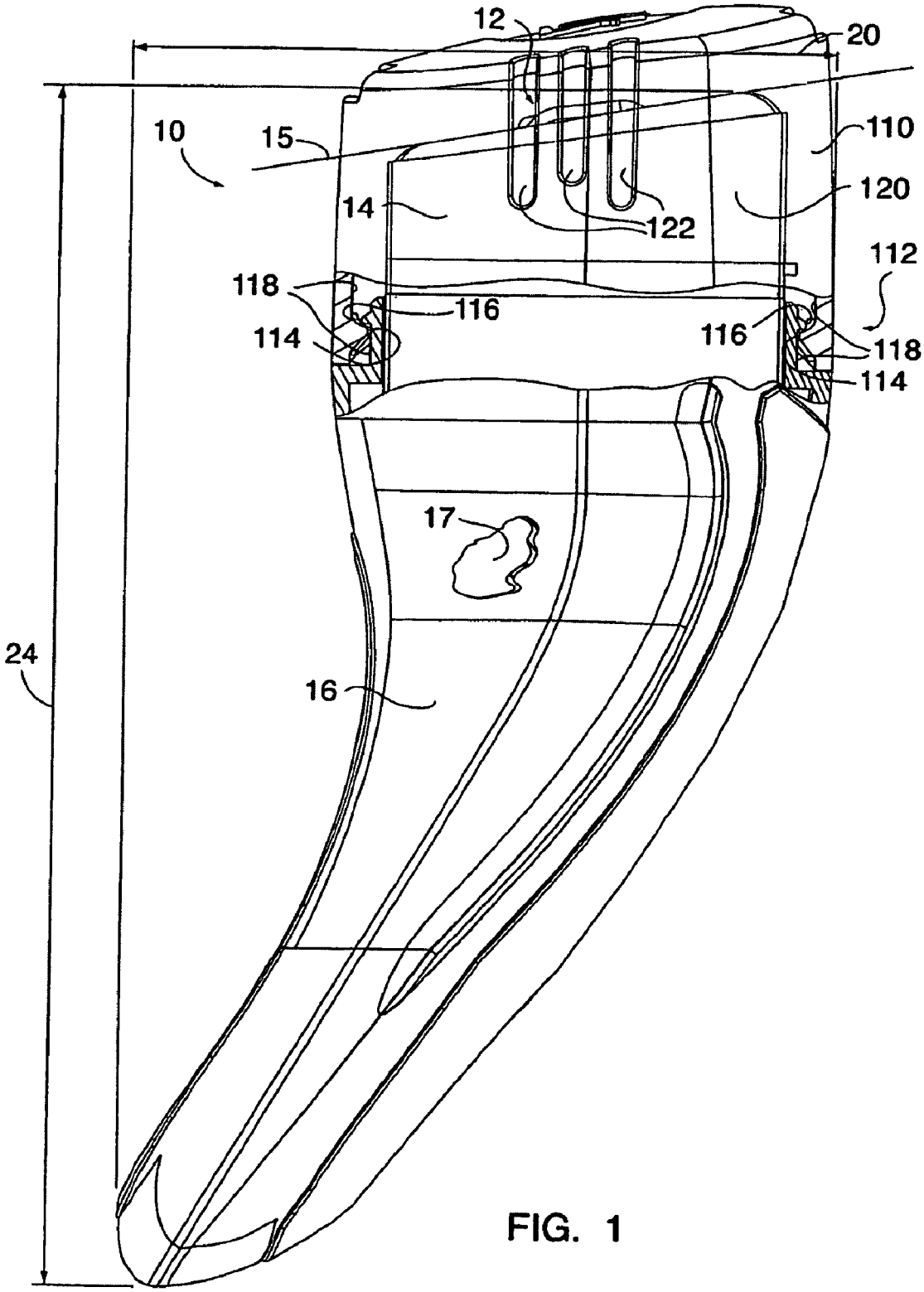
FIG. 1 is a side view of a present invention razor assembly.
Figure 2:
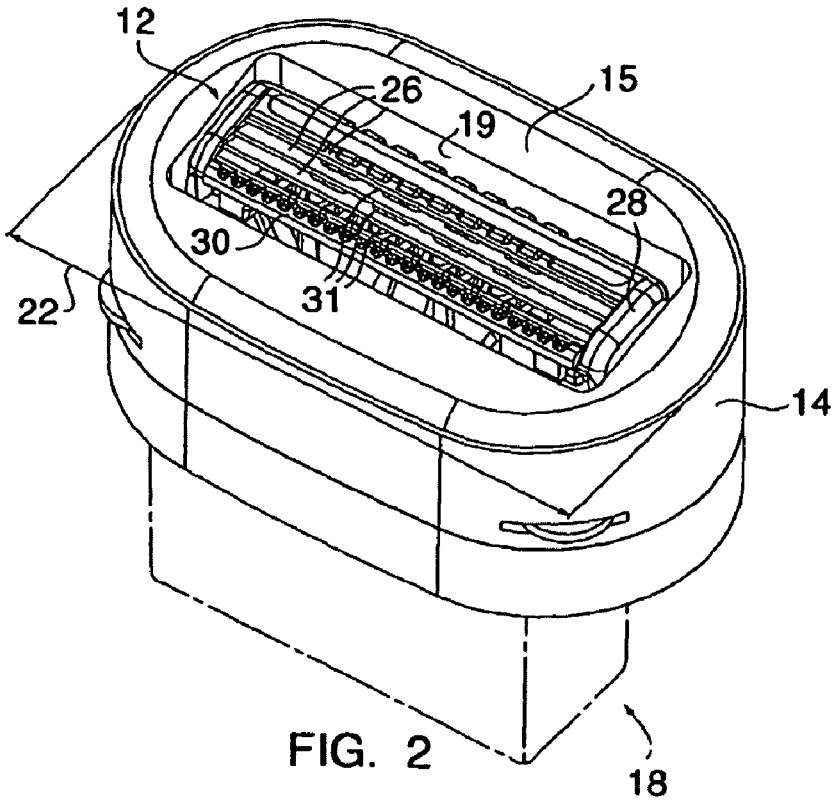
FIG. 2 is a perspective view of an embodiment of the present invention razor assembly without the handle attached.

Now referring to FIGS. 1 and 2, the present invention razor assembly 10 includes a razor cartridge 12, a shaving aid body 14, a handle 16, and a linkage 18. The razor assembly 10 can be described as having a width 20, a length 22, and a height 24.

The razor cartridge 12 includes one or more razor blades 26 attached to a frame 28. Each of the razor blades 26 has a lengthwise extending cutting edge 31. The razor cartridge 12 is connected to the linkage 18 as will be described in more detail below. Depending upon the application, the razor cartridge 12 may include a guard 30.

The shaving aid body 14, which includes a contact surface 15, is an erodable solid body that comprises one or more shaving aid materials (e.g., lubricating agents, drag reducing agents, depilatory agents, cleaning agents, medicinal agents, skin conditioning agents, etc.) to enhance the shaving process. The shaving aid body 14 is not limited to any particular type of shaving aid material, but rather can be selectively formulated to suit the application at hand. A solid soap material is an example of an acceptable shaving aid material for use in a wet shaving environment. In FIGS. 1 and 2, the shaving aid body 14 is shown as a single oval having a center aperture 19 in which the razor cartridge 12 is disposed. In alternative embodiments, the shaving aid body 14 can comprise one or more sections adjacent the razor cartridge 12; e.g., a forward portion, an aft portion, and/or side portions. Typically, but not necessarily, the shaving aid body 14 is mounted on a base configured to support the shaving aid body 14. For those embodiments that do include a base, the shaving aid body 14 may be produced with the base or it may be produced separately from the base and subsequently attached. As will be discussed below, the shaving aid body 14 may be produced without a base as part of a replacement cartridge. Examples of the present invention shaving aid body and base are disclosed in U.S. Provisional Patent Ser. No. 60/375,843, which is hereby incorporated by reference herein.

The linkage 18, shown schematically in FIG. 2 in phantom, includes at least one member that is connected to the razor cartridge 12 and the shaving aid body 14. The linkage member is connected to the razor cartridge 12, shaving aid body 14, and handle 16 in such a manner that movement of one of the razor cartridge 12 or the shaving aid body 14 in a first direction causes the other of the razor cartridge 12 and the shaving aid body 14 to move in a second direction substantially opposite the first direction.

In some embodiments, the linkage member is pivotally connected to the handle 16 at a point (i.e., the "handle pivot point") located between a pivot point connecting the linkage member and the razor cartridge 12, and a pivot point connecting the linkage member and the shaving aid body 14. The relative positioning of the pivot points enables the razor cartridge 12 and the shaving aid body 14 to move relative to each other, and move relative to the handle 16. With respect to the former, the pivot points of the razor cartridge 12 and the shaving aid body 14 to the linkage member, which are positioned on opposite sides of the handle pivot point, enable the razor cartridge 12 and the shaving aid body 14 to "seesaw" about the centrally located handle pivot point. With respect to the latter, the fixed position of the handle pivot point causes the razor cartridge 12 and the shaving aid body 14 to move relative to the handle 16. As a result, the surface of the shaving aid body 14 that will contact the surface to be shaved (i.e., contact surface 15) can be maintained approximately coplanar with the cutting edges 31 of the razor blades 26 within the razor cartridge 12.

The pivotal connections between the linkage member and the razor cartridge 12 and the shaving aid body 14 can be direct or indirect. In a direct pivotal connection, the linkage member is directly connected to the razor cartridge 12 and the shaving aid body 14. In an indirect connection, one or more intermediate members are disposed between the linkage member and the razor cartridge 12, and/or between the linkage member and the shaving aid body 14. For example, it is disclosed above that the shaving aid body 14 is typically mounted on a base for support. In such an arrangement the linkage member is pivotally attached to the base or other intermediate member rather than directly to the shaving aid body 14. Hence, the linkage member is indirectly pivotally connected to the shaving aid body 14. Further examples of direct and indirect linkages are provided below.

The relative positioning of the pivot points can be manipulated to add mechanical advantage and/or the relative amounts of travel of the pivotally attached razor cartridge 12 or shaving aid body 14. As indicated in the embodiments described above, one end of the linkage member is pivotally connected to the razor cartridge 12, the other end of the linkage member is pivotally connected to the shaving aid body 14, and the handle pivot point is located therebetween. The position of the handle pivot point relative to the other pivot points (i.e., the "end" pivot points) can be selectively chosen to provide mechanical advantage and/or change the relative amounts of travel of the pivotally attached razor cartridge 12 or shaving aid body 14. For example, a handle pivot point located equidistant from the end pivot points would provide neutral mechanical advantage and relative travel. If the handle pivot point were shifted toward one end pivot point, however, one of the razor cartridge 12 or shaving aid body 14 would gain mechanical advantage. In addition, the relative amounts of travel would be dissimilar. The exact relative positioning of the handle pivot point and the end pivot points can be chosen to suit the application at hand.

In another embodiment (see Example IV below), the linkage includes one or more flexible members. One end of each flexible member is connected to the razor cartridge 12 and the other end is connected to the shaving aid body 14. The flexible member is mounted within the handle 16 in a manner that permits the linkage member to travel around a point disposed within the handle 16. Movement of one of the shaving aid body 14 or razor cartridge 12 causes a portion of the attached flexible member to travel around the point, and consequently causes the other of the shaving aid body 14 or razor cartridge 12 to also move. In fact, the flexible member, shaving aid body 14, and razor cartridge 12 all move relative to the handle 16. As a result, the surface of the shaving aid body 14 (i.e., contact surface 15) that will contact the surface to be shaved can be maintained approximately co-planar with the cutting edges 31 of the razor blades 26 within the razor cartridge 12.

The term "approximately co-planar", as used herein, is used to describe any and all relative positions of the shaving aid body 14 and the razor cartridge 12 wherein the surface to be shaved (e.g., compliant skin) can be in contact with the contact surface 15 of the shaving aid body 14 and the cutting edges 31 of the razor blades 26.

The area of the shaving aid body contact surface 15 is selectively sized relative to the surface area of the razor cartridge 12 intended to be in contact with the surface to be shaved (referred to hereafter as the "razor cartridge contact surface area"). During the shaving process, the user forces the razor assembly against the surface to be shaved. The force, which can be described in terms of pressure (force per unit surface area), is uniformly applied to the shaving aid body 14 and the razor cartridge. If the surface area of the contact surface 15 and the razor cartridge surface area are equal, then the force applied by the user against the shaving aid body 14 and the razor cartridge 12 will likely also be equal. On the other hand, if the surface area of the contact surface 15 exceeds that of the razor cartridge 12, the force transmitted to the linkage 18 via the shaving aid body 14 will exceed that transmitted to the linkage 18 via the razor cartridge 12. As a result, the razor cartridge 12 will be biased towards the surface to be shaved. Hence, the surface area of the shaving aid body contact surface 15 is selectively sized relative to the razor cartridge contact surface area to provide a desirable result.

The relative sizing of the surface areas of the contact surface 15 and the razor cartridge contact area can be selectively chosen in combination with the above described relative positioning of the handle pivot point and the end pivot points to either cancel out mechanical advantage or to add mechanical advantage.

The handle 16 can include, but is not limited to, a stem, or a body having an internal cavity 17, or some combination thereof. The preferred handle 16 includes an ergonomic body that includes an internal cavity 17 for housing the linkage 18 and in some instances a portion of the shaving aid body 14. The ergonomic shape of the body facilitates the use of the razor assembly. As stated above, the handle 16 includes a pivotal connection to the at least one linkage member.

Referring to FIG. 1, in some embodiments, the razor assembly 10 includes a cover 110 that attaches to the handle 16. The cover 110 is sized to enclose the shaving aid body 14 and razor cartridge 12. The cover 110 and the handle 16 are preferably shaped to mate with one another in a manner that permits attachment of the cover 110 in one orientation only. For example, the cover 110 and the handle 16 may be asymmetrically shaped, or may include asymmetrical features. A means 112 for attaching the cover 110 to the handle 16 is provided that permits the user to selectively attach and remove the cover 110. The means 112 for attaching the cover 110 to the handle 16 shown in FIG. 1, for example, includes a pair of ribs 114 attached to the cover 110 that cooperate with a pair of ribs 116 attached to the handle 16. The ribs 114,116 cooperate with each other to clip the cover 110 to the handle 16. In the embodiment shown in FIG. 1, the ribs 114,116 are disposed along lengthwise-extending surfaces 118 of the cover 110 and handle 16, respectively. The cover 110 is compliant and shaped such that pressure applied to the widthwise-extending surfaces 120 of the cover 110 (i.e., squeezing the widthwise-extending surfaces 120 toward one another) causes the ribs 114,116 to disengage with one another and thereby allow the cover 110 to be removed from the handle 16. Other arrangements for securing the cover 110 to the handle 16 may be used alternatively. The cover 110 further includes at least one port 122 that permits liquid to drain out of the cover 110. Disposing more than one port 122 in the cover enables the cover 110 to drain in more than one position.

To illustrate the considerable utility of the present invention, examples of particular embodiments are given below to enable a complete appreciation of the present invention. These examples are exemplary, and do not represent all possible embodiments of the present invention.

EXAMPLE I

In an embodiment shown in FIGS. 1-8, a razor assembly 10 is provided that includes a razor cartridge 12, a shaving aid body 14, a handle 16, and a linkage 18 pivotally connected to the handle 16.

Figure 3:
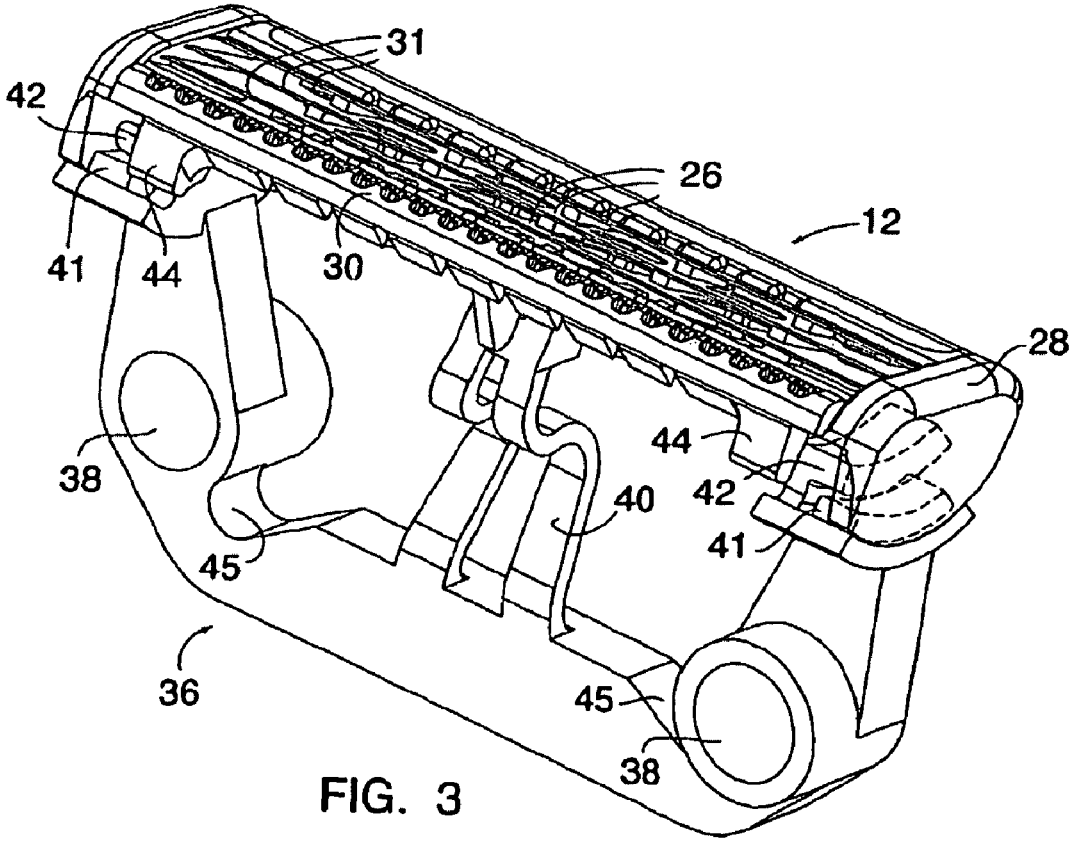
FIG. 3 is a perspective view of a razor cartridge attached to a holder.

Referring to FIG. 3, the razor cartridge 12 includes a guard 30 and a plurality of razor blades 26 attached to a frame 28. The razor cartridge 12 is pivotally attached to a holder 36 at each lengthwise end of the cartridge 12. The holder 36 includes a pair of mounting apertures 38 and a cartridge-biasing member 40. The holder 36 and the razor cartridge 12 are pivotally attached to one another by mating pairs of arcuately shaped features 41, 42 (e.g., tabs) at each lengthwise end. The arcuate shapes of the features 42, 41 define the pivotal path of the razor cartridge 12 relative to the holder 36. Physical stops 44 are provided to limit pivotal movement between the razor cartridge 12 and the holder 36. The cartridge-biasing member 40 extends out from the holder 36 and biases the razor cartridge 12 into a predetermined position. The cartridge-biasing member 40 resists rotation of the razor cartridge 12 relative to the holder 36.

A pair of relief slots 45 disposed adjacent the mounting apertures 38 permit the holder 36 to be elastically bent inward (e.g., using a snap-ring type tool) during assembly of the razor cartridge 12 to the holder 36. Once the pivotal attachment features 42, 41 of the razor cartridge 12 and the holder 36 are aligned with one another, the holder 36 is released and the features 42, 41 mate to form the pivotal attachment mechanism between the razor cartridge 12 and the holder 36.

Figure 4:
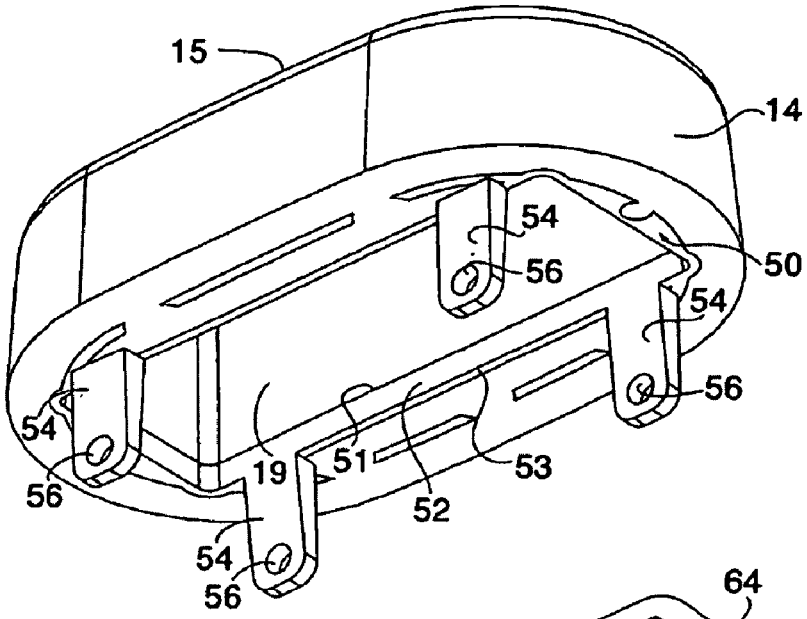
FIG. 4 is a perspective view of a shaving aid body attached to a base.
Figure 5:
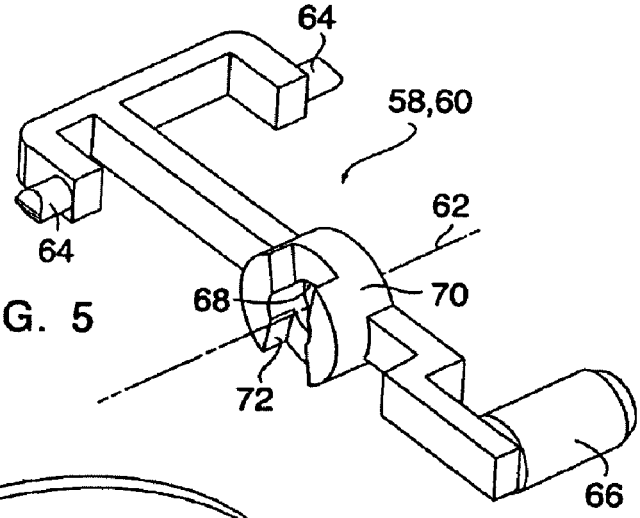
FIG. 5 is a perspective view of a linkage member.
Figure 6:
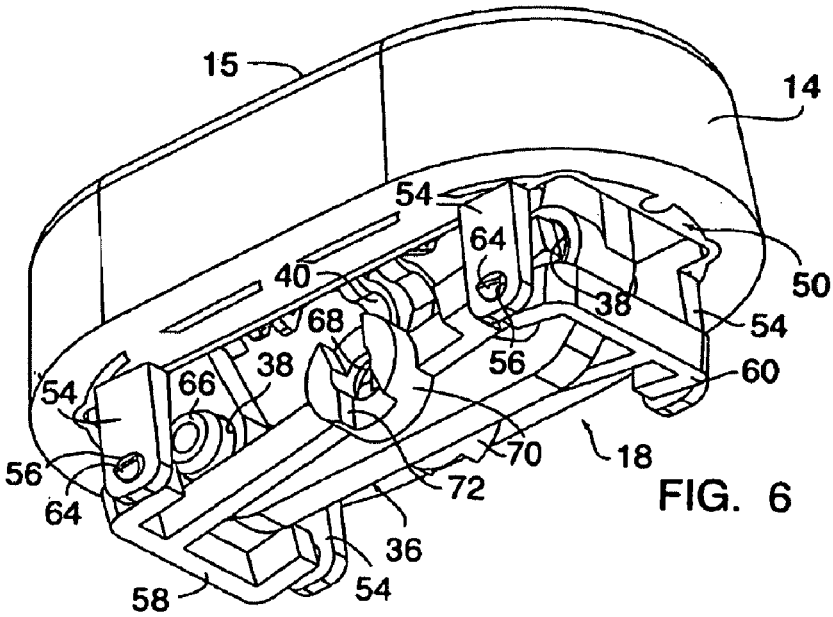
FIG. 6 is a perspective view of a replacement cartridge that includes the shaving aid body, base, linkage, holder, and razor cartridge.
Figure 7:
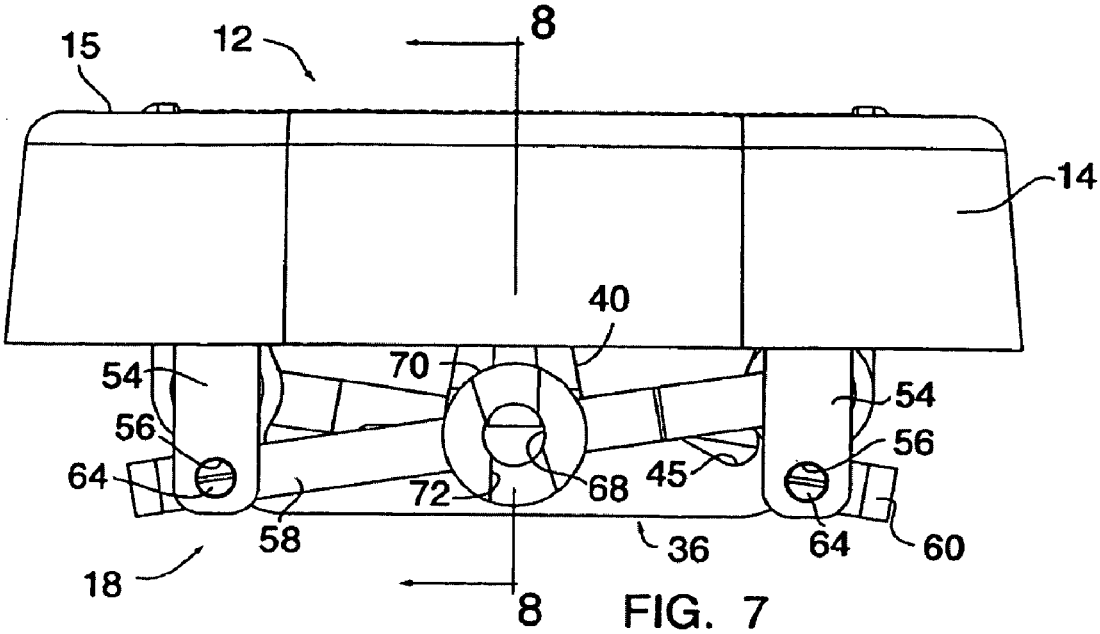
FIG. 7 is a front view of the replacement cartridge shown in FIG. 6.

Referring to FIG. 4, the shaving aid body 14 is oval shaped and has a contact surface 15 and a center aperture 19 for receiving the razor cartridge 12. The shaving aid body 14 is attached to a base 50 by an attachment means such as insert forming, insert molding, bonding, mechanical features, etc. The base 50 includes an upper surface 51, a lower surface 53, a center aperture 52 extending between the upper and lower surfaces 51,53 and four mounting tabs 54 extending out from the lower surface 53. One pair of the mounting tabs 54 is located at each lengthwise end of the base 50, and each tab 54 within the pair is spaced widthwise apart from the other. Each of the tabs 54 includes an aperture 56, and the apertures 56 within the pair at each lengthwise end are axially aligned with one another. The shape of each aperture 56 (e.g., circular, elliptical, slot, etc.) is selected to accommodate linkage movement as will be described below. In the embodiment shown in FIG. 4, the mounting tabs 54 are flush with the center aperture 52.

Referring to FIGS. 5-8, the linkage 18 includes a first member 58 and a second member 60 that extend between, and are pivotally connected to, the holder 36 and the base 50. The first and second members 58,60 are also pivotally attached to the handle 16. This embodiment is an example of a linkage that is indirectly pivotally connected to the razor cartridge 12 and the shaving aid body 14. This embodiment also illustrates a linkage that pivots about a widthwise-extending axis 62.

The first and second linkage members 58,60 each include a pair of base axles 64, a holder axle 66, and a center aperture 68 disposed in a center flange 70. The base axles 64 are sized and spaced apart so as to be receivable within the apertures 56 disposed within a pair of the base tabs 54. The holder axle 66 is sized and positioned so as to be receivable within one of the mounting apertures 38 disposed within the holder 36. In the embodiment shown, the center flange 70 includes a flared slot 72 for receiving a stop tab 76 extending out from the inside of the handle 16 as will be discussed below. The flared slot 72 in each linkage member 58,60 provides a pivotal travel limit for that linkage member. As an assembly, the first and second linkage members 58,60 form a scissors-type linkage extending between the base and the holder 36, the motion of which will be described in greater detail below in the "Operation of the Razor Assembly".

Figure 8:
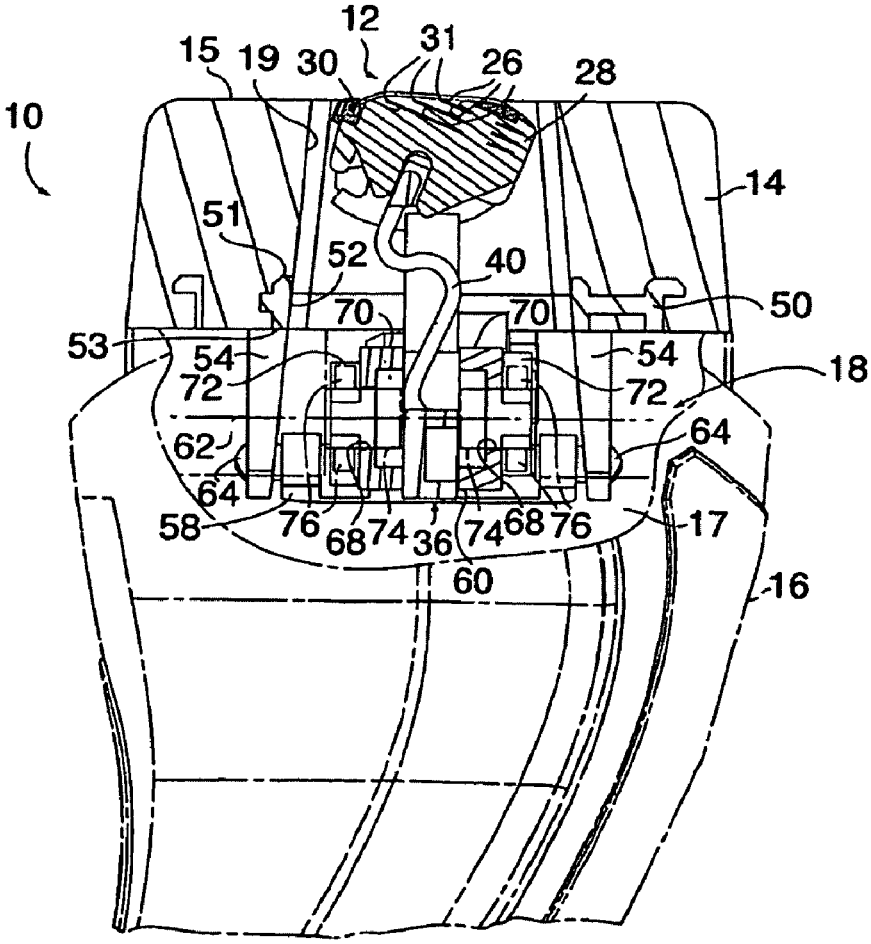
FIG. 8 is a sectional view of the replacement cartridge shown in FIG. 7 shown along line 8-8 including a handle partially shown.

Referring to FIG. 8, the handle 16 includes an internal cavity 17 that at least partially receives the holder 36, linkage 18, and base 50. The exterior of the handle 16 is ergonomically shaped to facilitate use of the razor assembly 10. The handle 16 includes a pair of linkage posts 74, each extending into the cavity 17 toward the other, and each aligned with the other. Each linkage post 74 includes a stop tab 76 for receipt within the flared slot 72 of the linkage center flange 70 as described above. The linkage posts 74 and the linkage center apertures 68 form the handle pivot points. When assembled, the sizing of the linkage posts 74, the center flanges 70, and/or the holder 36 (or some combination thereof) in some embodiments stacks up to form a slight interference fit. The interference fit slightly impedes, but does not prevent, motion between the razor cartridge 12 and shaving aid body 14. As a result, the relative positions of the razor cartridge 12 and the shaving aid body 14 can be maintained.

The pivotal connections between the: 1) base axles 64 and the base 50; 2) holder axles 66 and the holder 36; and 3) linkage posts 74 and the linkage members 58,60, are described above in terms of mating male and female pairs. In alternative embodiments, those elements described above as having the male half of the mating male/female pair can incorporate the female half of the pair, and vice versa, or other type pivotal arrangement.

As described above, the shaving aid body 14, base 50, razor cartridge 12, holder 36 and linkage 18 can be pre-assembled as an independent assembly that can be inserted into and removed from the handle 16 as a replaceable cartridge. Alternatively, one or more of the shaving aid body 14, base 50, razor cartridge 12, and holder 36 can be provided as independent replacement cartridges, or replacement cartridges formed from combinations thereof. For example, the shaving aid body 14 can be provided as an independent replaceable cartridge, or can be combined with the base 50 as a replaceable cartridge. If the shaving aid body 14 is provided as an independent replaceable cartridge, mechanical or other type attachment means can be used to attach the shaving aid body to the base 50. U.S. Provisional Patent Application Ser. No. 60/375,843, incorporated herein by reference, discloses such a replaceable cartridge. As another example, the razor cartridge 12 and holder 36 can also be combined as replaceable cartridge.

EXAMPLE II

In an embodiment shown in FIGS. 1, 2, and 9-22, a razor assembly 10 is provided that includes a razor cartridge 12, a holder 78, a shaving aid body 14, a base 80, a handle 16, and a linkage 18 pivotally connected to the handle 16.

Referring to FIGS. 2, 9-13, 15 and 16, the razor cartridge 12 includes a guard 30 and a plurality of razor blades 26 attached to a frame 28. The razor cartridge 12 is pivotally attached to the holder 78 at each lengthwise end of the cartridge. The holder (see FIG. 13) includes a plurality of guide panels 84, a pair of assembly apertures 86, and a cartridge-biasing member 88. In the embodiment shown in FIGS. 10-13, the holder 78 and the razor cartridge 12 are pivotally attached to one another by mating pairs of arcuately shaped features 90,91 (e.g., tabs) at each lengthwise end. The arcuate shape of the features 91,90 defines the pivotal path of the razor cartridge 12 relative to the holder 78. Other schemes for pivotally attaching the razor cartridge 12 to the holder 78 may be used alternatively. The assembly apertures 86 and a pair of relief slots 92 disposed adjacent the assembly apertures 86 permit the holder 78 to be elastically bent inward during assembly of the razor cartridge 12 to the holder 78. Once the pivotal attachment features 91,90 of the razor cartridge 12 and the holder 78 are aligned with one another, the holder 78 is released and the features 91,90 mate to form the pivotal attachment mechanism between the razor cartridge 12 and the holder 78. One or more bumpers 94 disposed within the relief slots 92 limit the amount the holder 78 can be bent. The cartridge-biasing member 88 extends out from the holder 78 and biases the razor cartridge 12 into a predetermined position. The cartridge-biasing member 88 resists rotation of the razor cartridge 12 relative to the holder 78.

Figure 13:
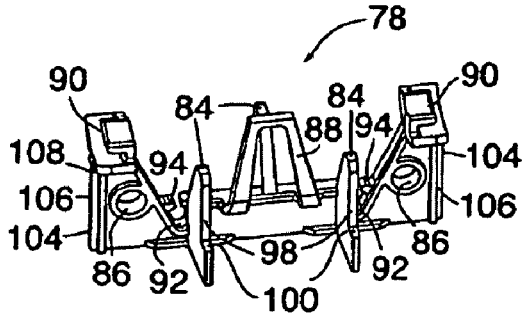
FIG. 13 is a perspective view of a holder.
Figure 14:
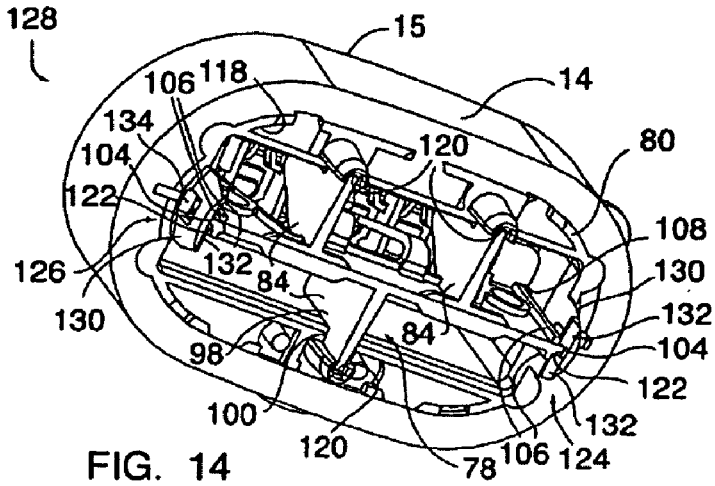
FIG. 14 is a perspective view of the replaceable cartridge.
Figure 15:
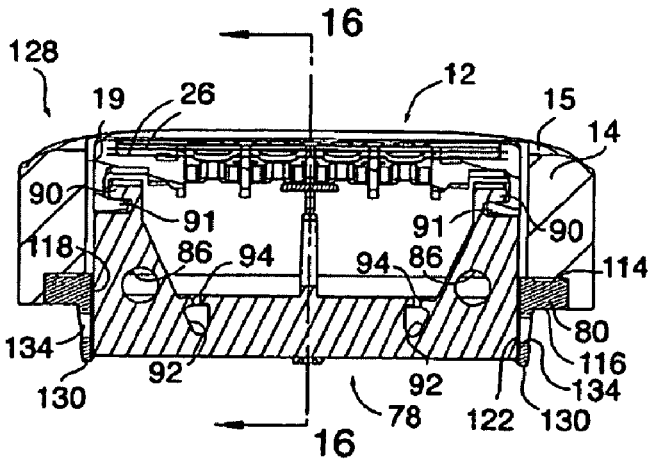
FIG. 15 is a sectional view of the replaceable cartridge.
Figure 16:
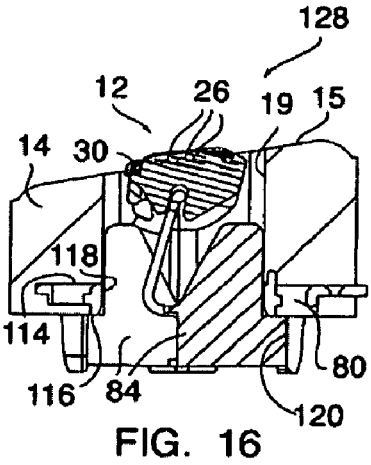
FIG. 16 is a sectional view of the replaceable cartridge along line 16-16 shown in FIG. 15.
Figure 17:
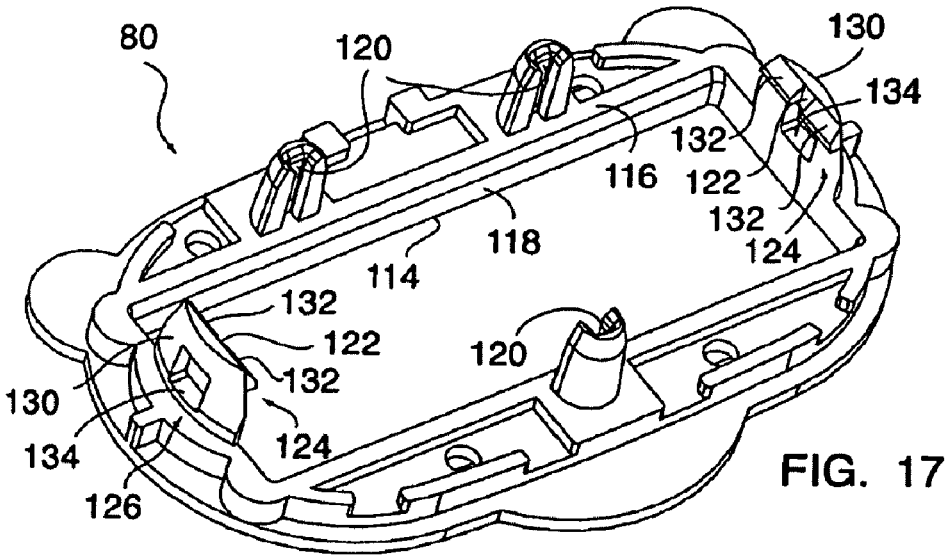
FIG. 17 is a perspective view of a base.

Referring to FIG. 13, a pair of guide panels 84 is disposed on one side of the holder 78 and a single guide panel 84 is disposed on the opposite side of the holder 78. The asymmetric number and position of the guide panels 84 on each side of the holder 78 assures that the holder 78 and the base 80 can only be assembled one way, as will be discussed below. Each guide panel 84 has a rail 98 and a stop 100. The stop 100 extends out from and is approximately perpendicular to the rail 98. In addition to the guide panels 84, the holder 78 further includes an end guide 104 at each lengthwise end of the holder 78. The end guides 104 include a pair of flanges 106 disposed a short distance inboard of each lengthwise end of the holder 78 (see FIGS. 9, 11, and 14). At the heightwise end of each "T-shaped" end guide 104 adjacent the razor cartridge 12, one or more stop tabs 108 (see FIGS. 9 and 11) are positioned to limit travel along the end guide 104.

Referring to FIGS. 9-12, and 14-17, the shaving aid body 14 is oval shaped and has a contact surface 15 and a center aperture 19 for receiving the razor cartridge 12. The shaving aid body 14 is attached to the base 80 by an attachment means such as insert forming, insert molding, bonding, mechanical features, etc. The base 80 includes an upper surface 114, a lower surface 116, a center aperture 118 extending between the upper and lower surfaces 114,116, a plurality of widthwise guide channels 120 (see FIG. 18), a plurality of end guide channels 122, one or more features 124 for retaining the holder 78, and one or more features 126 for connecting a replaceable cartridge 128 to the handle 16. The center aperture 118 is sized to receive the holder 78. The widthwise guide channels 120 and end guide channels 122 are shaped to mate with the guide panels 84 and the end guides 104, respectively, attached to the holder 78. The elements described above as having the male half of the mating male/female pair (e.g., the guide panels 84 and widthwise guide channels 120; the end guides 104 and end guide channels 122, respectively) can alternatively incorporate the female half of the pair, and vice versa, or some combination thereof. The mating male and female pairs (e.g., the guide panels 84 and widthwise guide channels 120; the end guides 104 and end guide channels 122, respectively) provide a means for guiding the holder 78 within the center aperture 118 of the base 80.

In the embodiment shown in FIGS. 9-12 and 14-16, a pair of the guide channels 120 is disposed adjacent a widthwise edge of the center aperture 118, and a single guide channel 120 is disposed adjacent the opposite widthwise edge of the center aperture 118. The guide channels 120 are positioned to align with the guide panels 84 of the holder 78. As stated above, the number and position of the guide panels 84 and guide channels 120 on each side of the holder 78 are preferably chosen to so that the holder 78 and the base 80 can only be assembled in a single orientation. An end guide channel 122 is disposed in each lengthwise end of the center aperture 118, positioned to align with and receive a holder end guide 104. A retainer flange 130 extends out from the lower surface 116 of the base 80 adjacent each lengthwise end of the center aperture 118. Each retainer flange 130 includes the one or more features 124 for retaining the holder 78 and the one or more features 126 for connecting a replaceable cartridge 128 to the handle 16. In the embodiment shown, the one or more features 124 for retaining the holder 78 consist of a pair of tabs 132 that extend out from the retainer flange 130 toward the center aperture. The tabs 132 are separated from one another by the end guide channel 122 and are positioned in the path of the stop tabs 108 attached to the holder 78. The features 126 for connecting a replaceable cartridge 128 to the handle 16 consist of an aperture 134 disposed in each retainer flange 130 for receiving a clip 154 as will be described below. The features 124 for retaining the holder 78 and the features 126 for connecting a replaceable cartridge 128 are not limited to the tab 132 and aperture 134 embodiments shown in the above-described embodiment.

It can be seen, therefore, that a replaceable cartridge 128 consisting of the razor cartridge 12, shaving aid body 14, holder 78, and base 80 can be assembled as a unitary assemblage that can be attached to and detached from the handle 16. The shaving aid body 14 is attached to the base 80, and the razor cartridge 12 is pivotally attached to the holder 78. The holder 78 and base 80 are slidably engaged with one another via the guide panels 84, widthwise guide channels 120, end guides 104, and end guide channels 122. Motion between the holder 78 and the base 80 is limited on one end of travel by the stop tabs 108 attached to the holder 78 and the tabs 132 attached to the base retainer flanges 130. Motion between the holder 78 and the base 80 is limited on the opposite end of travel by the stops 100 attached to the guide panels 84 intersecting with the widthwise edges of the base center aperture 118. Alternatively, one or more of the shaving aid body 14, base 80, razor cartridge 12, and holder 78 can be provided as independent replacement cartridges, or replacement cartridges formed from combinations thereof. For example, an alternative embodiment to that described above can utilize a base 80 that is attached to or integrally formed with the SAB carriage 138. In these embodiments, the base 80 is not intended to be removed from the linkage 18 as a disposable replacement item, and the shaving aid body 14 is a replacement item that can be selectively attached to and removed from the base 80 as required.

Referring to FIGS. 9-12 and 17-22, the linkage 18 includes a linkage member 136, a shaving aid body carriage 138 ("SAB carriage"), and a razor cartridge carriage 140 ("RC carriage"). The linkage member (see FIG. 19), hereinafter referred to as pivot link 136, includes at least one lengthwise-extending handle pivot axle 142, a first lobe 144, and a second lobe 146. The first lobe 144 is disposed on a first side of a lengthwise extending axis 148. The second lobe 146 is disposed on a second side of the lengthwise extending axis 148, opposite the first side. In the embodiment shown in FIG. 19, the pivot link 136 has a plurality of first lobes 144, and a plurality of second lobes 146.

Figure 20:
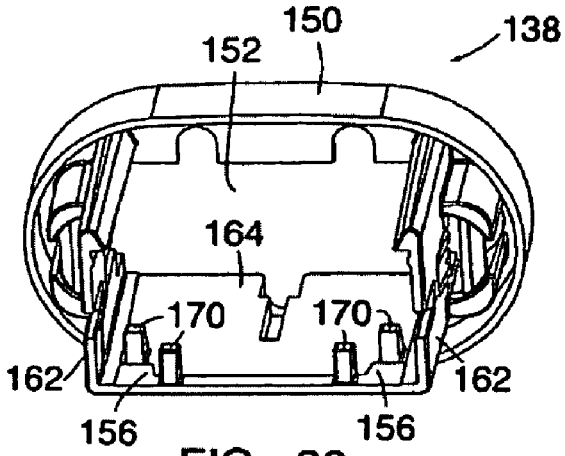
FIG. 20 is a perspective view of a shaving aid body carriage.
Figure 21:
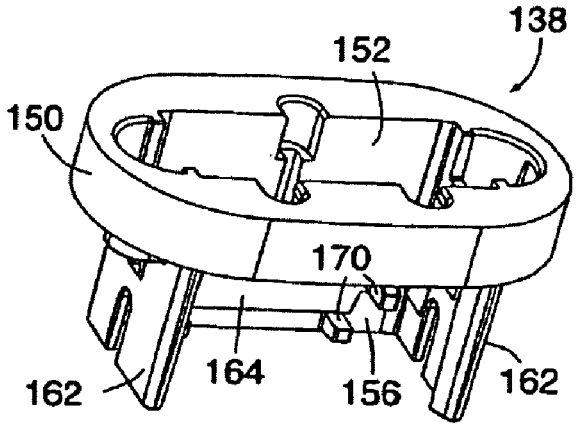
FIG. 21 is a perspective view of a shaving aid body carriage.

Referring to FIGS. 20 and 21, the SAB carriage 138 includes a collar 150 having a center aperture 152, one or more selectively actuable retaining clips 154 (see FIGS. 9 and 11), a pair of end panels 162, a center panel 164, and at least one seat 156. The collar 150 is sized to support the base 80 and shaving aid body 14. The end panels 162 and the center panel 164 extend out from the collar 150 around the center aperture 152. The one or more selectively actuable retaining clips 154 (see FIG. 9) are pivotally mounted on the collar 150. The retaining clips 154 are positioned to engage the apertures 134 disposed within the retaining flanges 130 of the base 80. The clips 154 are operable to selectively attach the base 80, and therefore the replaceable cartridge 128, to the linkage 18. The retaining clips 154 include a biasing means 166 that biases them into engagement with the apertures 134 disposed within the retainer flanges 130 of the base 80. The retaining clips 154 can be selectively pivoted out of engagement with the base 80 in some instances by the user directly pressing the retaining clips 154 through the handle 16. In other instances, the retaining clips 154 can be actuated indirectly via buttons 168 or the like mounted on the handle 16 that engage the retaining clips 154. In the embodiment shown in FIG. 9, because the buttons 168 are mounted on the handle 16, they engage the retaining clips 154 at different points depending on where the SAB carriage 138 is relative to the handle 16. The seat(s) 156 includes opposing pairs of tabs 170 that extend out from the center panel 164.

Figure 22:
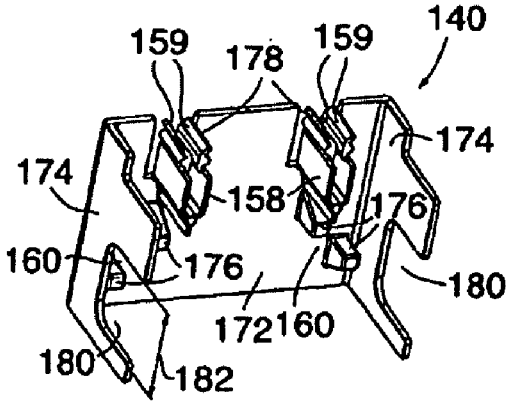
FIG. 22 is a perspective view of a razor cartridge carriage.

Referring to FIG. 22, the RC carriage 140 includes one or more saddles 158, at least one seat 160, a center panel 172, and a pair of side panels 174. Each saddle 158 extends out from the center panel 172 at a position to receive a guide panel 84 attached to the holder 78. Each saddle 158 includes a retaining clip 178 for gripping the respective guide panel 84 of the holder 78. The retaining clips 178 include guide surfaces 159 to facilitate attachment. Each seat 160 includes an opposing pair of tabs 176 that extend out from the center panel 172. A travel slot 180 having a height 182 is provided in each side panel 174.

Figure 10:
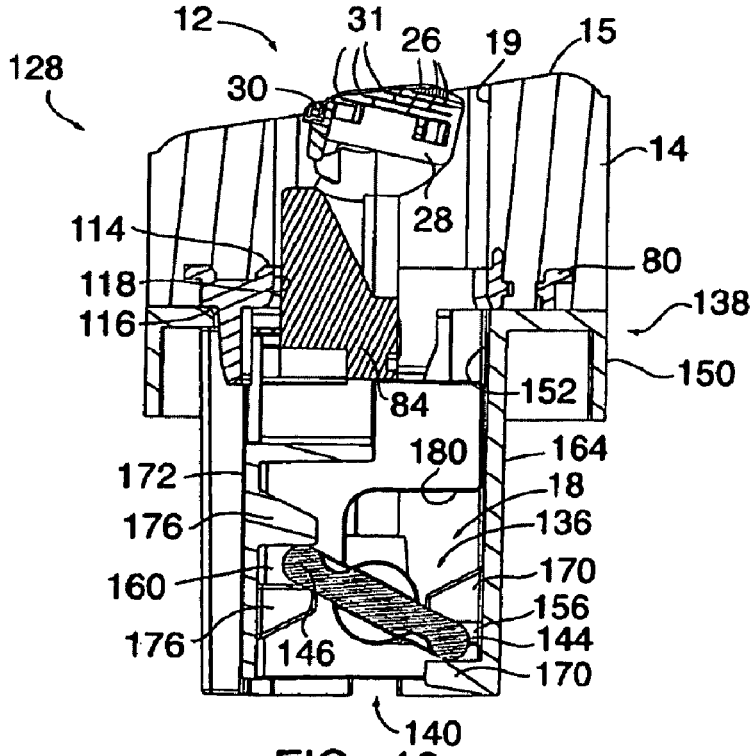
FIG. 10 is a sectional view along line 10-10 of FIG. 9.
Figure 12:
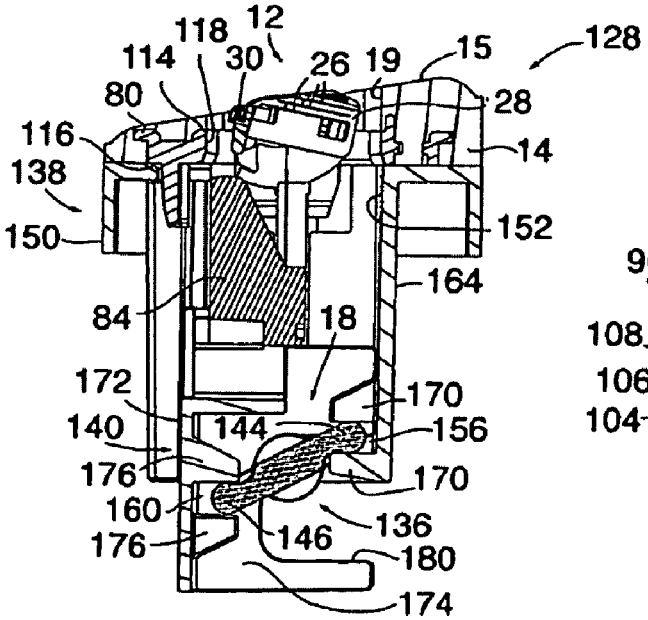
FIG. 12 is a sectional view along line 12-12 of FIG. 11.
Figure 18:
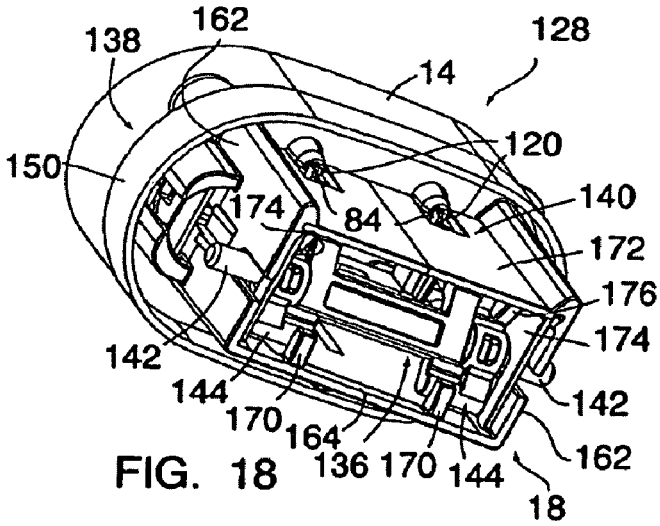
FIG. 18 is a perspective view of an embodiment of the present invention razor assembly without the handle attached.
Figure 19:
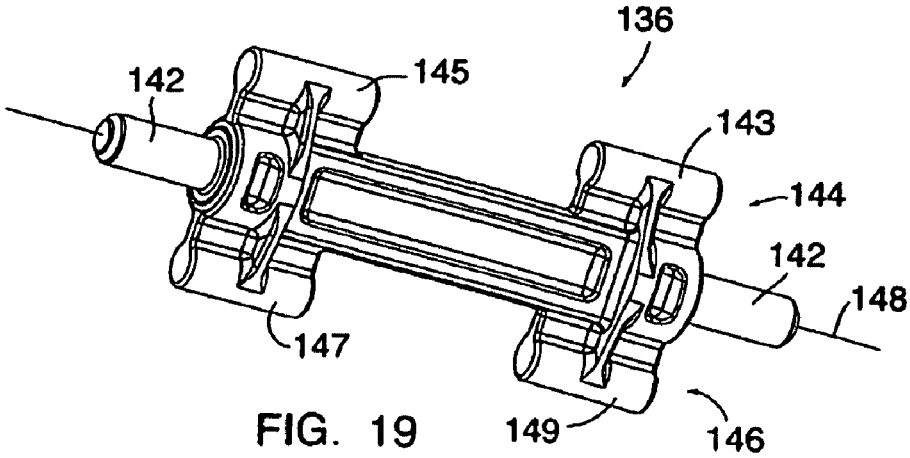
FIG. 19 is a perspective view of a linkage member.

The pivotal arrangement between the pivot link 136, SAB carriage 138, and RC carriage 140 can be readily seen in FIGS. 10, 12, and 18. The center panel 172 and side panels 174 of the RC carriage 140 are slidably disposed within the end panels 162 and center panel 164 of the SAB carriage 138. The pivot link 136 is disposed between the SAB carriage 138 and the RC carriage 140. Specifically, the first lobe 144 is received within the opposing pairs of tabs 170 attached to the SAB carriage 138, and the second lobe 146 is received between the opposing pairs of tabs 176 attached to the RC carriage 140. As will be discussed below in the "Operation of the Razor Assembly", rotation of the linkage member 136 causes the first lobe 144 to pivot relative to the seat 156 and move the SAB carriage 138 in a first direction, and causes the second lobe 146 to pivot relative to the respective seat 160 and move the RC carriage 140 in a second direction substantially opposite the first direction.

In an alternative embodiment, the pivot link 136 could be disposed in a widthwise extending arrangement; e.g. where the pivot link 136 is disposed substantially perpendicular to the orientation shown in FIGS. 9-12, and the seats 156,160 are positioned to receive the lobes 144,146.

Figure 9:
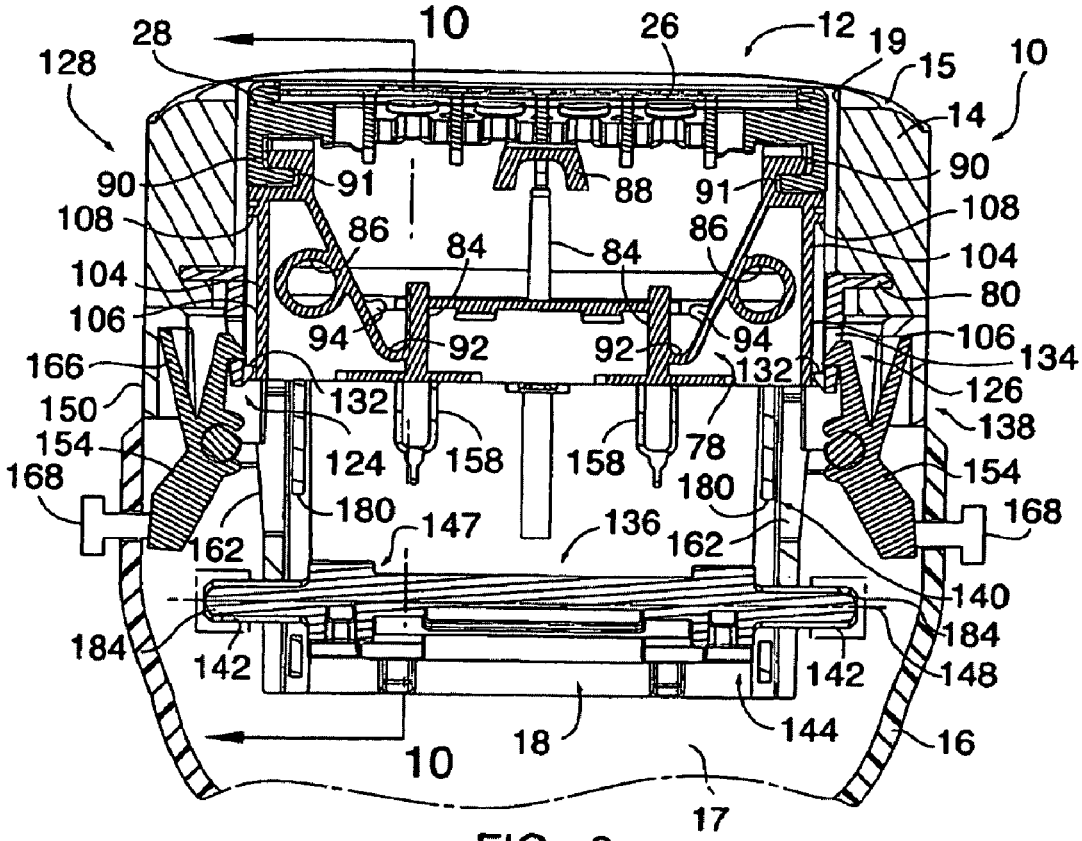
FIG. 9 is a sectional view of an embodiment of the present invention razor assembly with the shaving aid body in an uneroded state.
Figure 11:
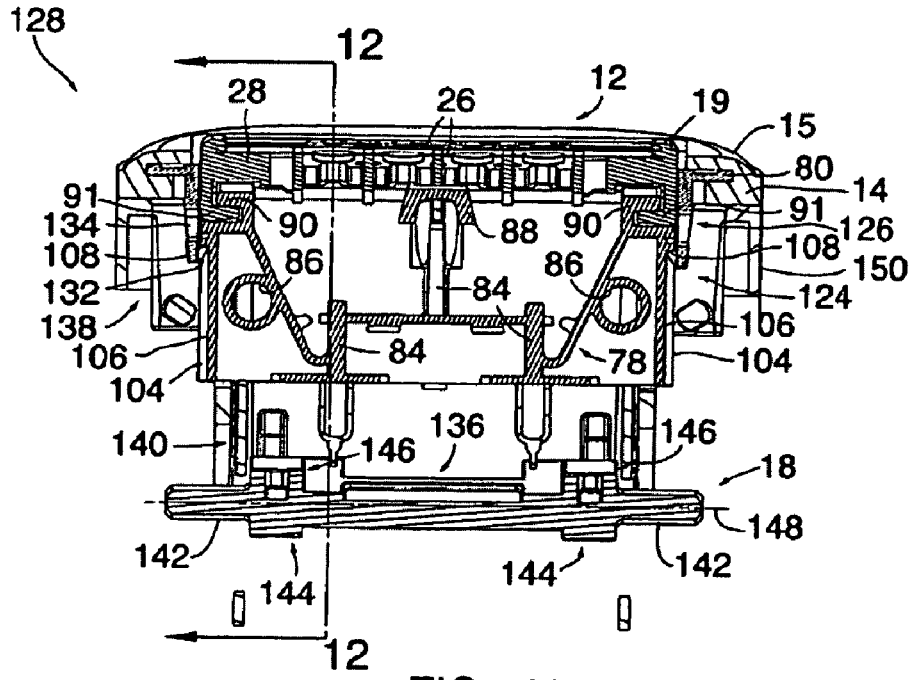
FIG. 11 is a sectional view of an embodiment of the present invention razor assembly with the shaving aid body in an eroded state.

Referring to FIGS. 1, 9, and 11, in this embodiment the handle 16 includes an internal cavity 17 sized to receive the linkage 18, and in some instances portions of the holder 78 and base 80 as well. The exterior of the handle 16 is ergonomically shaped to facilitate use of the razor assembly 10. The handle 16 includes a pair of bearing surfaces 184 positioned and sized to receive the handle pivot axles 142. In some embodiments, the sizing of some or all of the above described components (e.g., holder 78, base 80, SAB carriage 138, and/or RC carriage 140) stack up to form a slight interference fit when the components are assembled. The interference fit slightly impedes, but does not prevent, motion between the razor cartridge 12 and shaving aid body 14. As a result, the relative positions of the razor cartridge 12 and the shaving aid body 14 can be maintained.

EXAMPLE III

Figure 23:
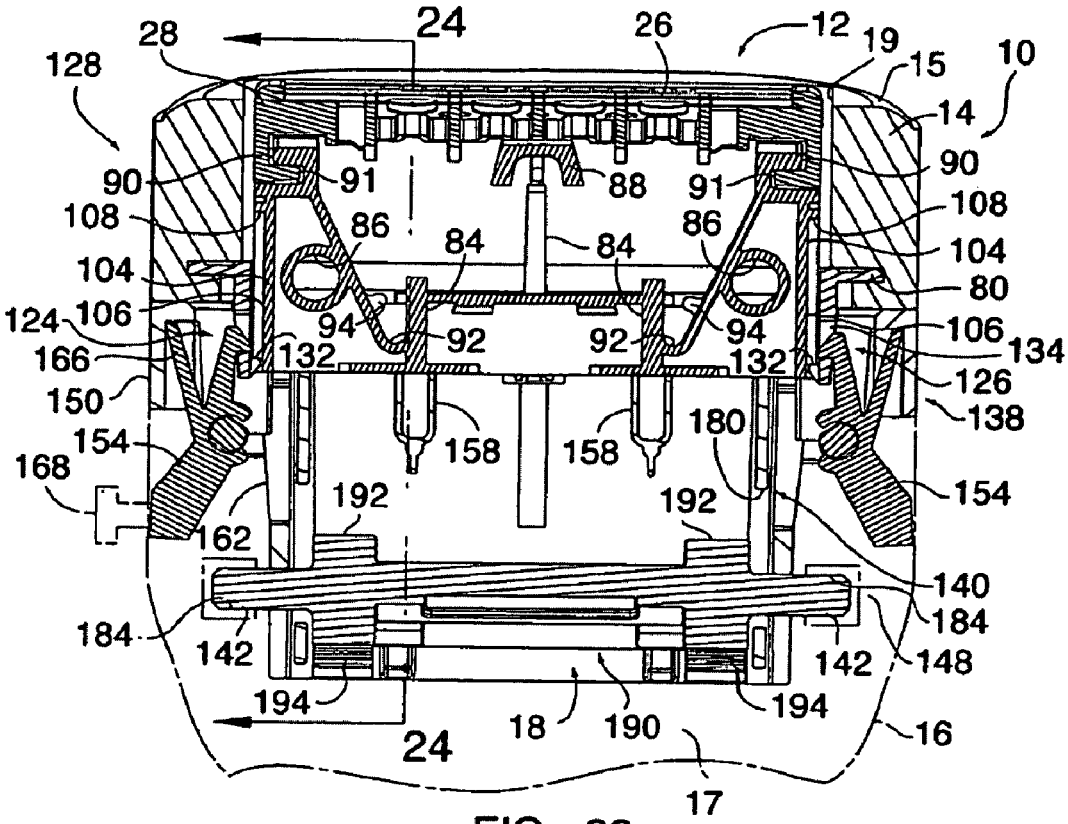
FIG. 23 is a sectional view of an embodiment of the present invention razor assembly with the shaving aid body in an uneroded state.
Figure 24:
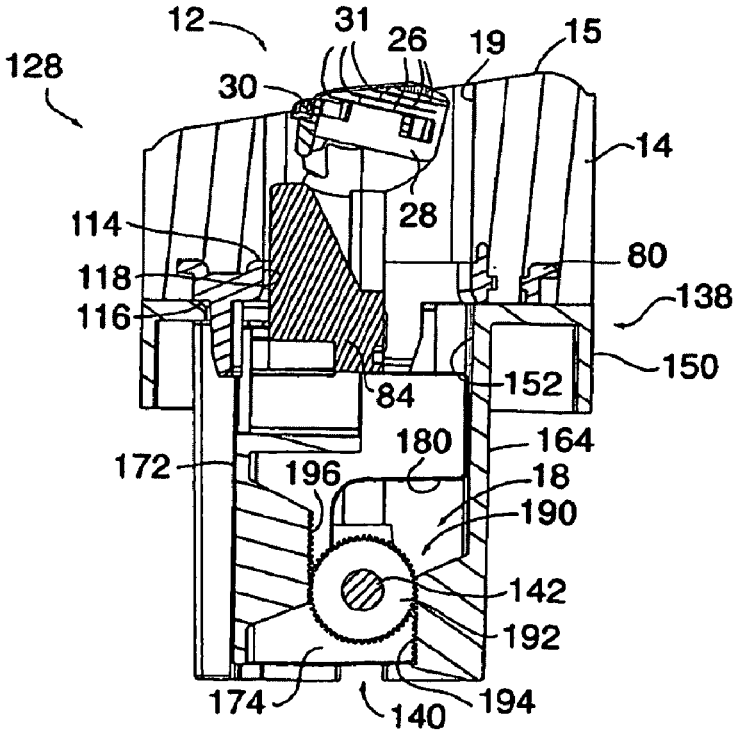
FIG. 24 is a sectional view along line 24-24 of FIG. 23.

In an embodiment shown in FIGS. 23 and 24, a razor assembly 10 similar to that described above in Example II is shown having a different linkage. In this embodiment, the linkage 18 includes a linkage member 190, a shaving aid body carriage 138 ("SAB carriage"), and a razor cartridge carriage 140 ("RC carriage"). The linkage member 190 hereinafter referred to as a pivot link 190, includes at least one lengthwise-extending handle pivot axle 142, and a pair of pivot rollers 192.

The SAB carriage 138 is similar to that described in Example II except that it includes a pair of roller rails 194 in place of seats 156. The RC carriage 140 is also similar to that described in Example II except that it includes a pair of roller rails 196 in place of seats 160.

The pivot rollers 192 of the pivot link 190 and the roller rails 194,196 of the SAB carriage 138 and RC carriage 140 have complimentary features that function in the manner described below. For example, the pivot rollers 192 may be a circular toothed gear that meshes with gear teeth disposed on the linear roller rails 194,196. In another example, the pivot rollers 192 may have protrusions (e.g., semicircular shaped buttons) spaced around the circumference of the rollers 192, that positively engage a compliant material (e.g., a rubber type material) disposed on the roller rails 194,196 (or vice versa). In another example, the pivot rollers 192 and/or the roller rails 194,196 may include materials that frictionally engage each other. The above examples represent different features that can be used with the pivot rollers 192 and the roller rails 194,196 that will enable them to interact in the manner described below in the "Operation of the Razor Assembly". The present invention is not, however, limited to these examples.

The pivotal arrangement between the pivot link 190, SAB carriage 138, and RC carriage 140 can be readily seen in FIGS. 23 and 24. The center panel 172 and side panels 174 of the RC carriage 140 are slidably disposed within the end panels 162 and center panel 164 of the SAB carriage 138. The pivot link 190 is disposed between the SAB carriage 138 and the RC carriage 140. Specifically, the pivot rollers 192 are disposed between and engaged with the roller rails 194,196. As will be discussed below in the "Operation of the Razor Assembly", rotation of the linkage member 190 causes the pivot rollers 192 to rotate and move the SAB carriage 138 in a first direction and the RC carriage 140 in a second direction substantially opposite the first direction.

In an alternative embodiment, the pivot axle 142 could be disposed in a widthwise extending arrangement; e.g. where the pivot roller(s) 192 is disposed substantially perpendicular to the orientation shown in FIGS. 23 and 24, and the roller rails 194,196 are positioned to engage the pivot roller 192.

The handle 16 (see FIG. 1) in this example is similar to that described in Example II and will not, therefore, be described here again.

EXAMPLE IV

Figure 25:
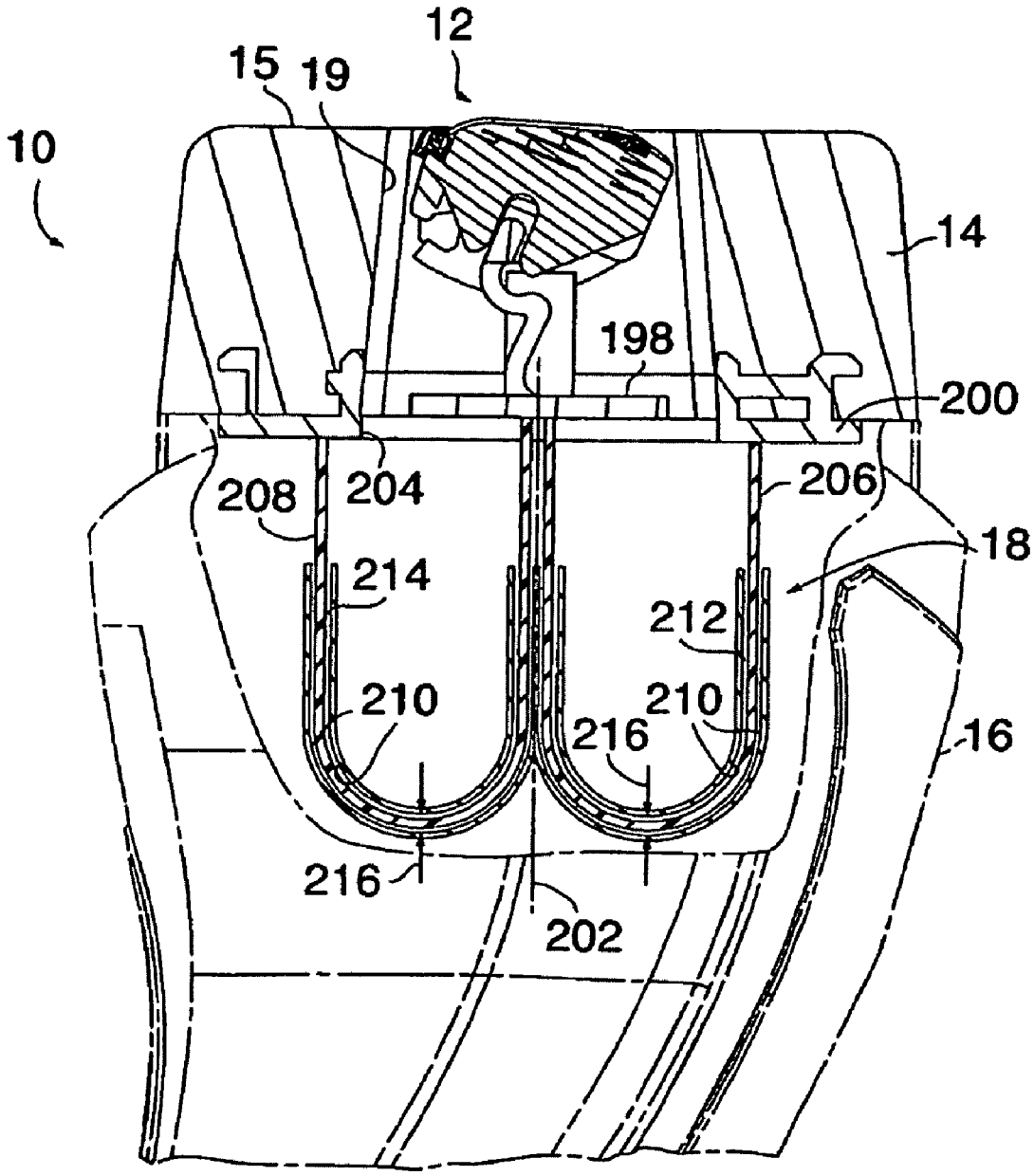
FIG. 25 is a diagrammatic view of an embodiment of the present invention razor assembly.

In an alternative embodiment schematically shown in FIG. 25, a razor assembly 10 is provided that includes a razor cartridge 12, a holder 198, a shaving aid body 14, a base 200, a handle 16, and a linkage 18 mounted within the handle 16. The razor cartridge 12 is attached to the holder 198. The holder 198 is slidably mounted and guided to permit linear motion substantially parallel to a travel path represented as line 202. The shaving aid body 14 is oval shaped and has a contact surface 15 and a center aperture 19 for receiving the razor cartridge 12. The shaving aid body 14 is attached to the base 200 by an attachment means such as insert forming, insert molding, bonding, mechanical features, etc. The base 200 includes a center aperture 204 for receiving the holder 198 and/or the linkage 18. The base 200 is slidably mounted and guided to permit linear motion in the direction substantially parallel to the line 202.

Referring to FIG. 25, the linkage 18 includes a pair of linkage members 206,208 extending between the holder 198 and the base 200. Each linkage member 206,208 is a flexible band directly or indirectly attached to the holder 198 on one end, and to the base 200 on the other end. The embodiment shown in FIG. 25, for example, shows the linkage members 206,208 attached to the holder 198 and the base 200, and therefore indirectly connected to the razor cartridge 12 and the shaving aid body 14. The flexible linkage members 206, 208 are mounted within the handle 16 in a manner that that permits the linkage members 206,208 to pivot around a point disposed in the handle 16. Guide surfaces 210, for example, form a first channel 212 and a second channel 214. Each linkage member 206,208 is received within one of the channels 212,214. The gap 216 between the guide surfaces 210 of each channel 212,214 (i.e., the width of the channel) is sized large enough to permit the linkage member 206,208 to travel therethrough without binding, and small enough to prevent appreciable side to side deflection within the channel 212, 214. As will be discussed below, travel of the linkage members 206,208 through the channels 212,214 causes the holder 198 and attached razor cartridge 12 to move in a first direction, and causes the base 200 and attached shaving aid body 14 to move in a second direction substantially opposite the first direction.

When assembled, the one or more of the above-described components (e.g., holder 198, base 200, linkage members 206,208) may be subject at least in part to a slight interference fit. The interference fit slightly impedes, but does not prevent, motion between the razor cartridge 12 and shaving aid body 14. As a result, the relative positions of the razor cartridge 12 and the shaving aid body 14 can be maintained.

As described above in Examples 1-3, one or more of the shaving aid body 14, base 200, razor cartridge 12, and holder 198 can be provided as independent replaceable cartridges, or as replacement cartridges in the form of combinations thereof.

EXAMPLE V

Figure 26:
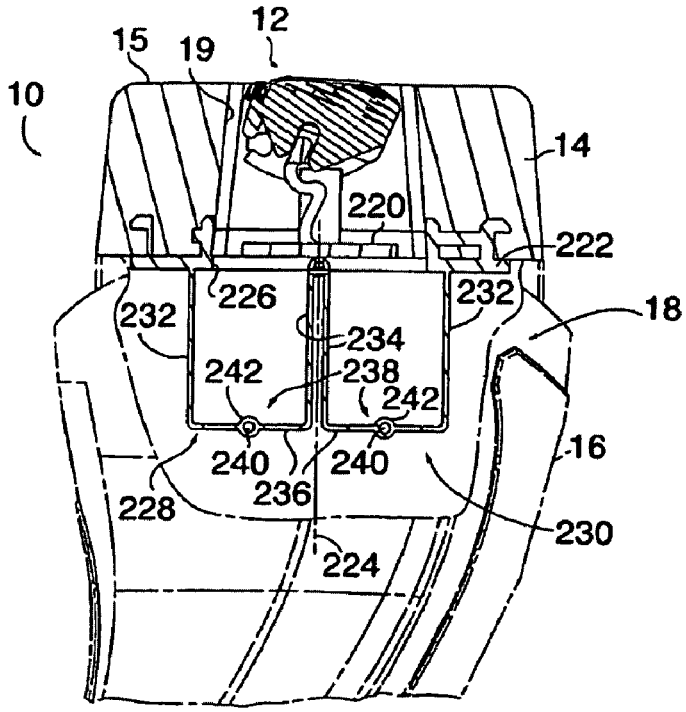
FIG. 26 is a diagrammatic view of an embodiment of the present invention razor assembly.
Figure 27:
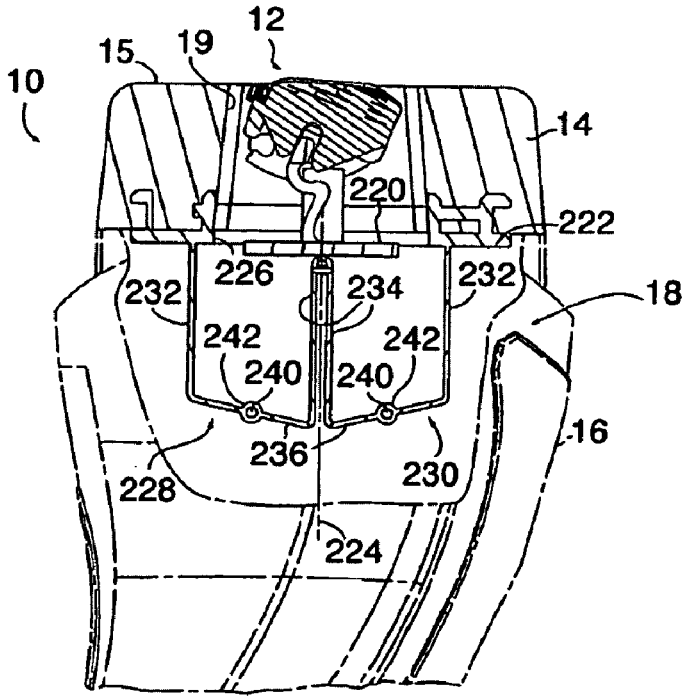
FIG. 27 is a diagrammatic view of the embodiment shown in FIG. 26, showing the linkage in a different position.
Figure 28:
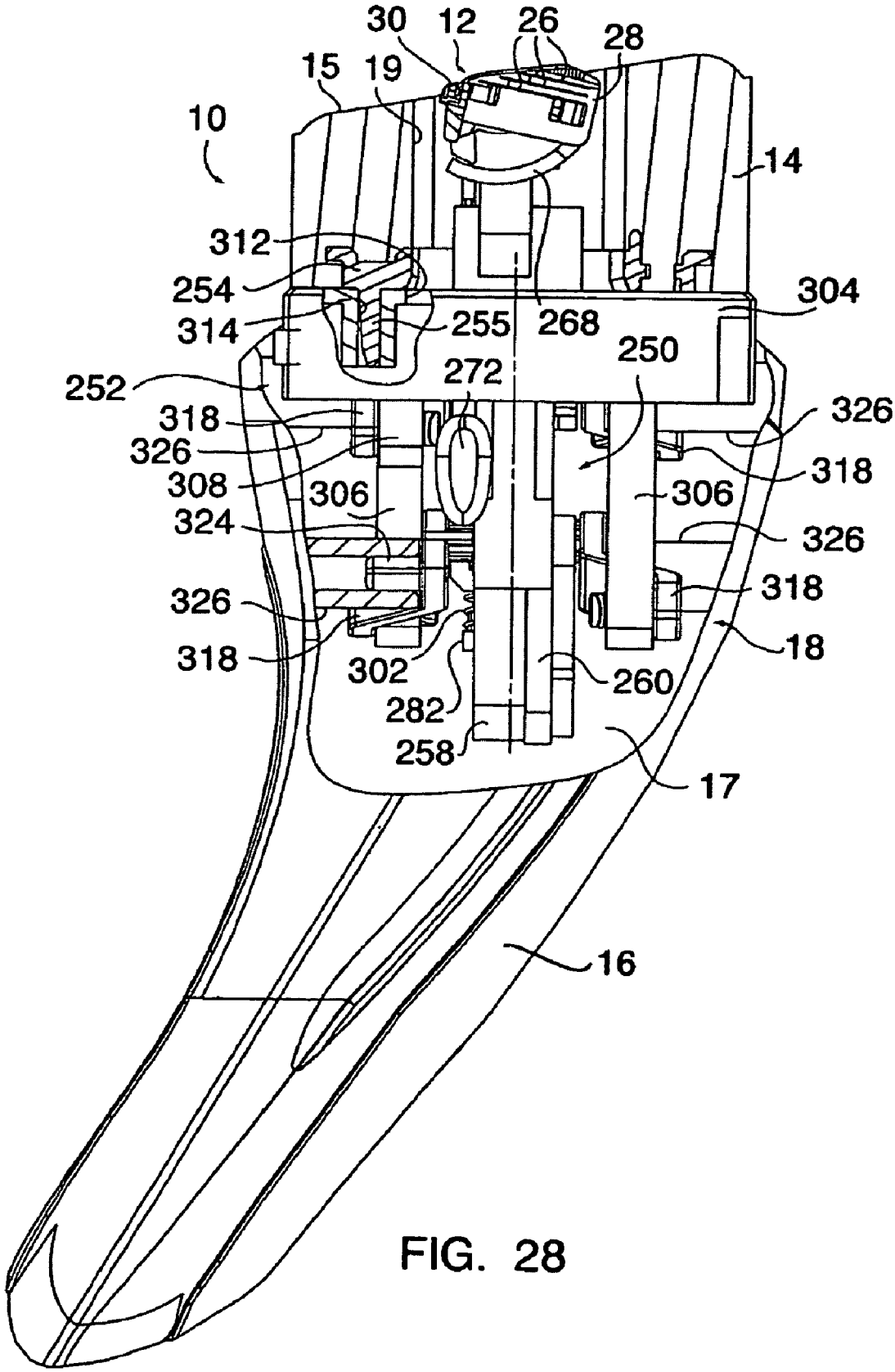
FIG. 28 is a diagrammatic view of an embodiment of the present invention razor assembly.
Figure 29:
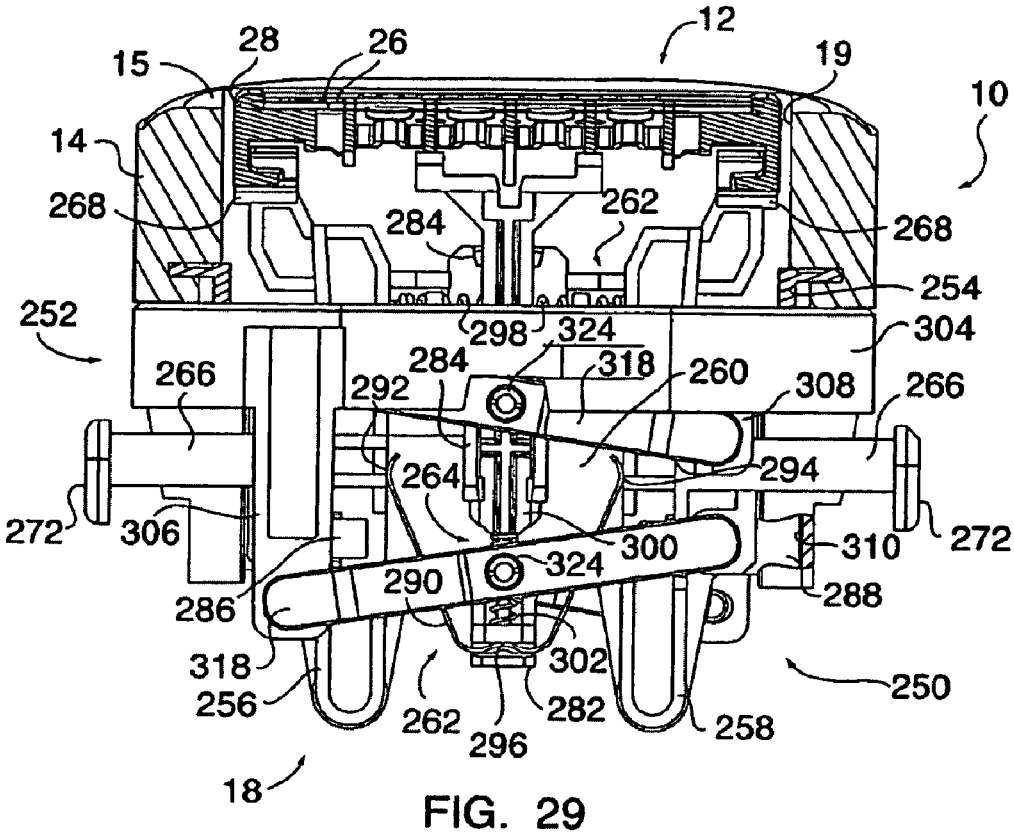
FIG. 29 is a diagrammatic view of a portion of the razor assembly embodiment shown in FIG. 28.
Figure 30:
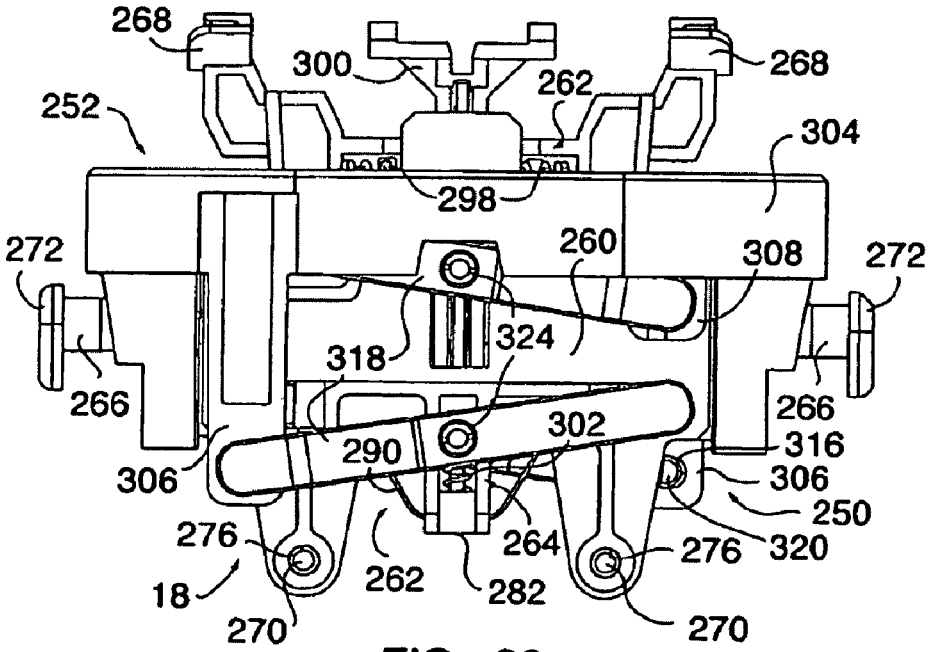
FIG. 30 is the opposite side view of the diagrammatic view shown in FIG. 29, shown without a razor cartridge or a shaving aid body.
Figure 31:
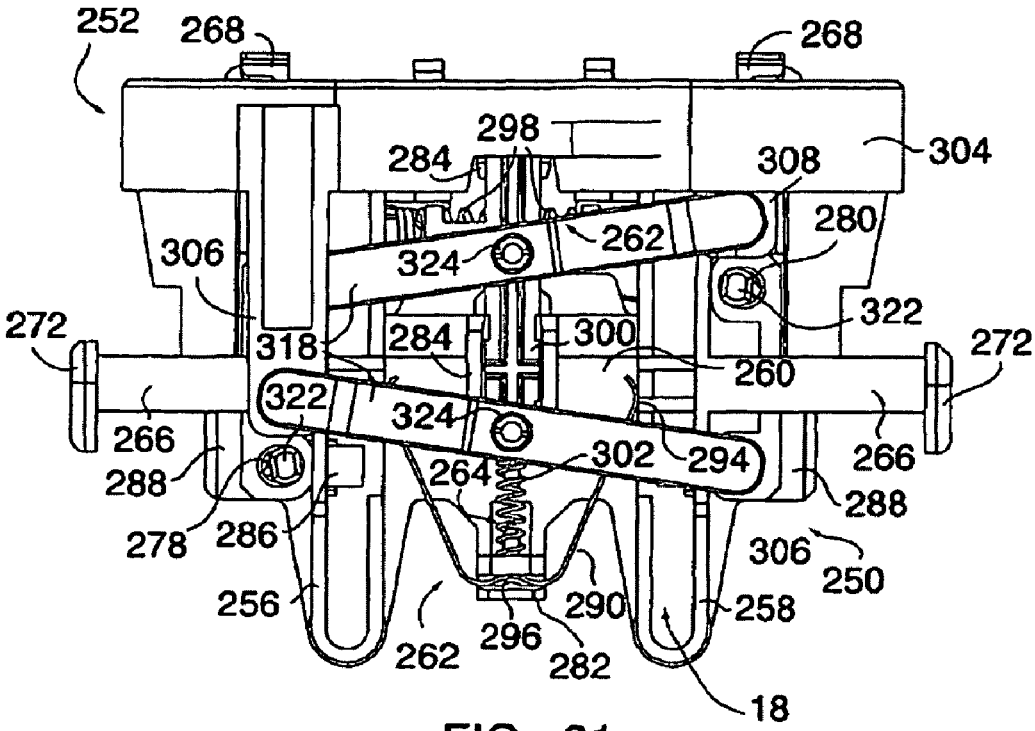
FIG. 31 is a diagrammatic view of a portion of the razor assembly embodiment shown in FIG. 28, showing the RC carriage and the SAB carriage in different relative positions.
Figure 32:
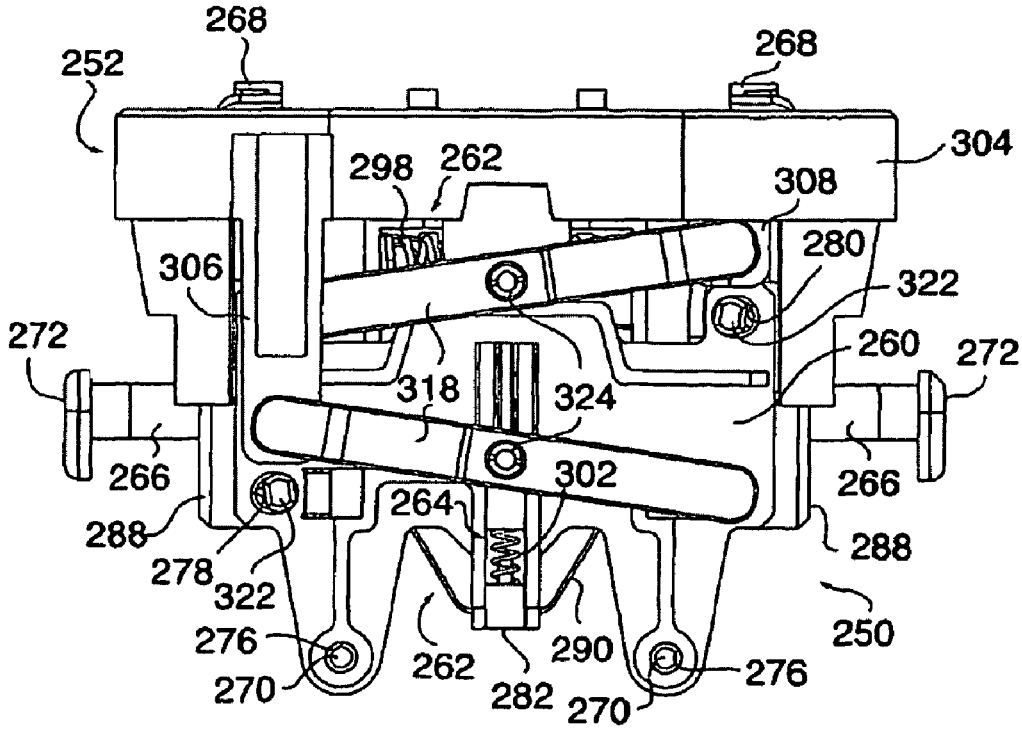
FIG. 32 is the opposite side view of the diagrammatic view shown in FIG. 31.

In an alternative embodiment schematically shown in FIGS. 26 and 27, a razor assembly 10 includes a holder 220, a shaving aid body 14, a base 222, a handle 16, and a linkage 18 mounted within the handle 16. The razor cartridge 12 is attached to the holder 220. The holder 220 is slidably mounted and guided to permit linear motion substantially parallel to a travel path represented as line 224. The shaving aid body 14 is similar to that described above; e.g., it is oval shaped and has a contact surface 15 and a center aperture 19 for receiving the razor cartridge 12. The shaving aid body 14 is attached to the base 222 by an attachment means such as insert forming, insert molding, bonding, mechanical features, etc. The base 222 includes a center aperture 226 for receiving the holder 220 and/or the linkage 18. The base 222 is slidably mounted and guided to permit linear motion in the direction substantially parallel to the line 224.

The linkage 18 includes at least one linkage member 228, 230 extending directly or indirectly between the shaving aid body 14 and the razor cartridge 12. The at least one linkage member 228,230 is pivotally mounted within the handle 16. The embodiment shown schematically in FIGS. 26 and 27, for example, includes a first linkage member 228 and a second linkage member 230. Each linkage member 228, 230 includes a first leg 232, a second leg 234, and a center link 236 extending between, and pivotally attached to, the first leg 232 and the second leg 234. The first leg 232 of each linkage member 228,230 is attached to the base 222 and is, thereby indirectly attached to the shaving aid body 14. The second leg 234 of each linkage member 228,230 is attached to the holder 220 and is, thereby indirectly attached to the razor cartridge 12. The first leg 232 and second leg 234 could, alternatively, be attached directly to the shaving aid body 14 and the razor cartridge 12, respectively. The center link 236 of each linkage member 228,230 includes a pivot joint 238 that enables the center link 236 to pivot relative to the handle 16. In the embodiment shown in FIGS. 26 and 27, a stub axle 240 attached to the handle 16 is received within a bearing mount 242 attached to the center link 236. Other types of pivot joints 238 may be used alternatively between the handle 16 and the center link(s) 236.

As will be discussed below in the "Operation of the Razor Assembly", rotation of the center link 236 of each linkage member 228,230 causes the first arms 232 and the shaving aid body 14 to travel in a first direction and the second arms 234 and the razor cartridge to travel in a second direction substantially opposite the first direction.

EXAMPLE VI

In an embodiment shown in FIGS. 28-37, a razor assembly 10 is provided that includes a razor cartridge 12, a shaving aid body 14, a razor cartridge carriage 250, a shaving aid body carriage 252, a base 254, a handle 16, and a linkage 18 pivotally connected to the handle 16. The razor cartridge 12 includes a guard 30 and a plurality of razor blades 26 attached to a frame 28.

Referring to FIGS. 28-33, the razor cartridge carriage ("RC carriage") 250 includes a first arm 256 and a second arm 258 pivotally mounted on a frame 260, means 262 for biasing the arms, means 264 for biasing the razor cartridge, and a pair of actuator stems 266. The first arm 256 and the second arm 258 are the same except that one is a left-hand version and the other is a right hand version. One or more arcuately shaped features 268 for pivotally attaching the razor cartridge 12 to an arm 256,258 are attached to one end of each arm 256,258. The razor cartridge 12 and the arms 256,258 are attached in a manner the same as or similar to that described above in Examples I and II between the holder 36,78 and the razor cartridge 12. A pivot axle 270 extends out from the other end of each arm 256,258. An actuator stem 266 is attached to and extends laterally outward from each arm 256,258. A button-like pad 272 is fixed to the end of each actuator stem 266. An arm guide flange aperture 274 is disposed in each arm 256, 258. The frame 260 includes a pair of arm apertures 276, a pair of lower link apertures 278, a pair of upper link apertures 280, a biasing member mounting bracket 282, a plurality of post guide flanges 284, a plurality of arm guide flanges 286, and a plurality of frame guide flanges 288. The means 262 for biasing the arms 256,258 includes one or more biasing members acting on each arm 256,258 that bias the arms towards each lengthwise end of the razor assembly 10, and therefore into engagement with the razor cartridge 12. In the embodiment shown in FIGS. 28-36, the one or more biasing members include a leaf spring 290 having a first end 292, a second end 294, and a mounting feature 296 disposed between the first end 292 and second end 294, and a pair of coil springs 298. The means 264 for biasing the razor cartridge 12 includes a post 300 and a biasing member 302 (e.g., a coil spring).

The RC carriage 250 is assembled as a unitary assembly that is slidably received within the SAB carriage 252 as will be described below. The pivot axle 270 extending out from an arm 256,258 is received within one of the arm apertures 276 disposed within the frame 260, thereby enabling pivotal motion between the arms 256,258 and the frame 260. The arm guide flanges 286 attached to the frame 260 are received within the arm guide flange apertures 274 disposed within the arms 256,258. In the embodiment shown in FIGS. 29-32, the first end 292 of the leaf spring 290 acts against the first arm 256, and the second end 294 of the leaf spring 290 acts against the second arm 258, thereby biasing the arms 256,258 toward the respective lengthwise ends of the razor assembly 10. The mounting feature 296 is engaged with the biasing member mounting bracket 282, and thereby attached to the frame 260. One of the coil springs 298 is disposed between the first arm 256 and the frame 260 and the other coil spring 298 is disposed between the second arm 258 and the frame 260. Like the leaf spring 290, the coil springs 298 bias the arms 256,258 toward the respective lengthwise ends of the razor assembly 10. Pressure applied to the actuator stems 266 that is sufficient to overcome the force of the means for biasing the arms 262 will cause the arms 256,258 to pivot inwardly, away from the lengthwise ends of the razor assembly 10. A predetermined amount of inward movement of the arms 256,258 will cause the razor cartridge 12 and the arms 256,258 to disengage and thereby release the razor cartridge 12. Conversely, moving the arms 256,258 inwardly the predetermined amount will also allow a razor cartridge 12 to be attached to the razor assembly 10. In this embodiment, because the actuator stems 266 are attached to the RC carriage 250, they move with the RC carriage 250 and therefore travel relative to the handle 16. The post 300 portion of the means 264 for biasing the razor cartridge 12 is slidably disposed between the plurality of post guide flanges 284. The biasing member 302 portion of the means 264 for biasing the razor cartridge 12 acts between the frame 260 and the post 300. The means 264 for biasing the razor cartridge 12 operates in a manner similar to that described above; e.g., it biases the razor cartridge 12 into a predetermined position and resists rotation of the razor cartridge 12 relative to the arms 256,258.

The shaving aid body 14 is the same as or similar to that described above; e.g., oval shaped and has a contact surface 15 and a center aperture 19 for receiving the razor cartridge 12. The shaving aid body 14 is attached to the base 254 by an attachment means such as insert forming, insert molding, bonding, mechanical features, etc. The base 254 includes one or more mechanical features 255 (e.g., posts, tabs, pins, etc.) for attaching the base 254 to the SAB carriage 252.

Figure 36:
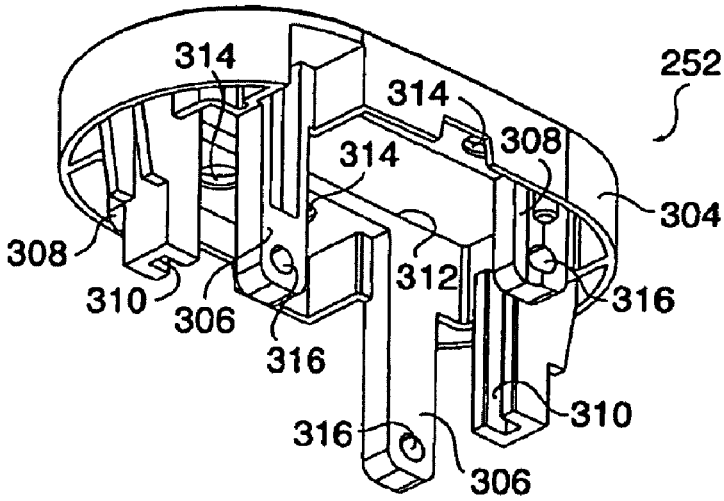
FIG. 36 is a perspective view of a SAB Carriage.
Figure 33:
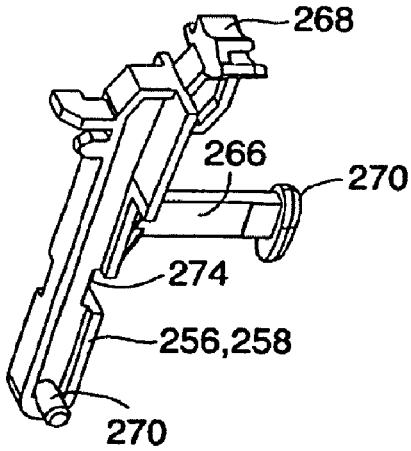
FIG. 33 is a perspective view of an arm.
Figure 34:
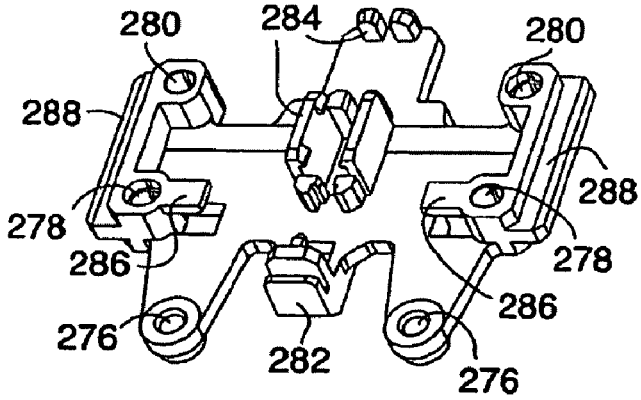
FIG. 34 is a perspective view of a frame.
Figure 35:
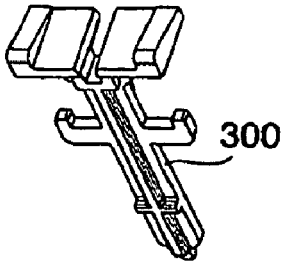
FIG. 35 is a perspective view of a post.
Figure 37:
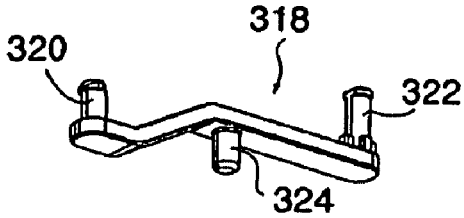
FIG. 37 is a perspective view of a link.

Referring to FIG. 36, the SAB carriage 252 includes a collar 304, a pair of first posts 306, a pair of second posts 308, and a pair of guide channels 310. The collar 304 includes a center aperture 312, and one or more features 314 for engaging with the features 255 attached to the base 254. In FIG. 36, the features 314 are shown as apertures for receiving male features 255 extending out from the base 254. Other attachment arrangements may be used alternatively. The first posts 306 and second posts 308 extend outwardly from the collar 304 and each includes an aperture 316. The length of the first posts 306 is greater than the length of the second posts 308. A first post 306 and a second post 308 is disposed on each widthwise side of the center aperture 312. One of the guide channels 310 is disposed on each lengthwise side of the center aperture 312.

Referring to FIGS. 29-31, and FIG. 37, the linkage 18 includes four links 318, each having a SAB carriage axle 320, a RC carriage axle 322, and a housing axle 324. The SAB carriage axle 320 extends outwardly from one end of each link 318, the RC carriage axle 322 extends outwardly from the opposite end of the link 318, and the housing axle 324 extends outwardly from the link 318 at a position between the other two axles 320,322. The housing axle 324 is disposed on one side of each link 318. The SAB carriage axle 320 and the RC carriage axle 322 are disposed on the side of the link 318 opposite the housing axle 324. When assembled, the RC carriage 250 is slidably received within the center aperture 312 of the SAB carriage 252. A frame guide flange 288 is received within a guide channel 310 at each lengthwise end of the center aperture 312. Two links 318 are disposed on each side of the RC carriage 252, and each extends between the RC carriage 250 and the SAB carriage 252. One of the two links 318 on each side extends between a first post 306 and a lower link aperture 278. The other of the two links 318 on that side extends between a second post 308 and an upper link aperture 280. In each case, the SAB carriage axle 320 is disposed in the aperture 316 of the respective post 306,308, and the RC carriage axle 322 is disposed in the respective link aperture 278,280. When assembled, the links 318 form a scissors-type linkage extending between the SAB carriage 252 and the RC carriage 250. The motion of the SAB carriage 252 and the RC carriage 250 enabled by the linkage 18 which will be described in greater-detail below in the "Operation of the Razor Assembly".

The handle 16 includes an internal cavity 17 that at least partially receives the RC carriage 250 and the SAB carriage 252. The exterior of the handle 16 is similar to that described above. In the internal cavity 17, the handle 16 includes a pair of bearing mounts 326 on each side for receiving the housing axles 324 of the links 318 disposed on that side. In some embodiments, the sizing of elements within the RC carriage 250, the SAB carriage 252, and the handle 16 are such that a slight interference fit is formed. The interference fit slightly impedes, but does not prevent, motion between the razor cartridge 12 and shaving aid body 14. As a result, the relative positions of the razor cartridge 12 and the shaving aid body 14 can be maintained.

The pivotal connections between the various axles and bearing mounts or apertures are described in this example in terms of mating male and female pairs. In alternative embodiments, those elements described above as having the male half of the mating male/female pair can incorporate the female half of the pair, and-vice versa, or other type pivotal arrangement.

As described above, one or more of the shaving aid body 14, base 254, razor cartridge 12, and holder 220 can be provided as independent replaceable cartridges, or as replacement cartridges in the form of combinations thereof.

Operation of the Razor Assembly:

During operation of the razor assembly, including the various embodiments described in the examples above, the razor cartridge 12 is typically initially positioned such that the cutting edges 31 of the one or more razor blades 26 within the razor cartridge 12 are approximately co-planar with the contact surface of the new shaving aid body. During use, the razor assembly 10 is exposed to water and the razor assembly 10 is drawn along the surface to be shaved. As a result, the shaving aid body 14 begins to erode and provide, for example, a lubricating medium for the surface to be shaved. In the preferred embodiment wherein the shaving aid body 14 is an oval body that surrounds the razor cartridge 12, the shaving aid body 14 deposits shaving aid material regardless of the user's stroke direction. As the user shaves, the erosion of the shaving aid body 14 causes the body 14 to decrease in height. Absent a mechanism to account for the change in height to the shaving aid body 14, the razor cartridge 12 would soon be exposed and the lubricating function provided by the shaving aid body 14, inter alia, would be inhibited.

The present invention razor assembly 10 advantageously enables the shaving aid body 14 and razor cartridge 12 to maintain the original orientation between the contact surface 15 of the shaving aid body 14 and the razor blades of the razor cartridge 12. Force applied by the user is approximately distributed to those portions of the razor cartridge 12 and shaving aid body 14 in contact with the surface to be shaved. As the shaving aid body 14 erodes and the contact surface 15 of the shaving aid body 14 consequently approaches the handle 16, the relative positions of the shaving aid body 14 and the razor cartridge 12 change (e.g., see FIGS. 9-12). The orientation of the razor cartridge 12 and the contact surface 15 of the shaving aid body 14 does not change, however. The force applied to the razor assembly 10 causes the razor cartridge 12 to move toward the interior of the handle 16, and the linkage 18 to pivot. The pivotal (i.e., "seesaw") movement of the linkage 18 causes the shaving aid body 14 to travel away from the interior of the handle 16; i.e., in a direction substantially opposite the direction of the razor cartridge 12 motion. As a result, the contact surface 15 is maintained approximately co-planar with the cutting edges 31 of the one or more razor blades 26 within the razor cartridge 12.

Referring to FIGS. 1-9, in terms of the embodiment disclosed in Example I movement of the razor cartridge 12 toward the interior of the handle 16, causes the linkage members 58,60 to pivot about the handle pivot point formed between the linkage posts 74 and the center apertures 68. The pivoting of the linkage members 58,60 in turn causes the base 50 and attached shaving aid body 14 to travel away from the interior of the handle 16; i.e., in a direction substantially opposite the direction of the razor cartridge 12 motion. As a result, the contact surface 15 is maintained approximately co-planar with the cutting edges 31 of the razor blades 26 within the razor cartridge 12. In this manner, the positions of the shaving aid body 14 and the razor cartridge 12 are continuously adjusted to maintain the approximately co-planar orientation during the useful life of the replaceable cartridge 12. Relative motion between the shaving aid body 14 and the razor cartridge 12 is possible until the stop tabs 76 attached to the linkage posts 74 contact one side of the flared slots 72 within the center flanges 70. The width of the flared slots 70 is chosen to allow an amount of travel by the stop tabs 76 within the slots 70 that comports with the erodable height of the shaving aid body 14. Now referring to FIGS. 1, 2, and 9-22, in terms of the embodiment disclosed in Example II, movement of the razor cartridge 12 toward the interior of the handle 16 causes the holder 78 and the RC carriage 140 to travel toward the interior of the handle 16. The movement of the RC carriage 140 causes the pivot link 136 to pivot relative to the handle 16 (i.e., the handle pivot axle 142 remains in the same position relative to the handle 16 and pivots). The rotation of the pivot link 136 in turn causes the SAB carriage 138, base 80, and attached shaving aid body 14 to travel in a direction away from the interior of the handle 16; i.e., a direction substantially opposite the travel of the razor cartridge 12. As a result, the positions of the shaving aid body 14 and the razor cartridge 12 are continuously adjusted to maintain the approximately co-planar orientation during the useful life of the replaceable cartridge 128. Relative motion between the shaving aid body 14 and the razor cartridge 12 is limited by the pivot axles 142 of the pivot link 136 contacting the ends of the travel slots 180 disposed within the RC carriage 140.

Now referring to FIGS. 23 and 24, in terms of the embodiment disclosed in Example III, movement of the razor cartridge 12 toward the interior of the handle 16 causes the holder 78 and the RC carriage 140 to travel toward the interior of the handle 16. The movement of the RC carriage 140 causes the pivot link 190 and attached pivot rollers 192 to pivot relative to the handle 16 (i.e., the handle pivot axles 142 remain in the same position relative to the handle 16 and pivot). The rotation of the pivot rollers 192 in turn causes the SAB carriage 138, base 80, and attached shaving aid body 14 to travel in a direction away from the interior of the handle 16; i.e., a direction substantially opposite the travel of the razor cartridge 12. As a result, the positions of the shaving aid body 14 and the razor cartridge 12 continuously adjust to maintain the approximately co-planar orientation during the useful life of the replaceable cartridge 128. As indicated above, the mechanism by which the pivot rollers 192 and roller rails 194,196 engage each other can assume a variety of forms (e.g., gears, protrusions, frictional material, etc.), and the present invention is not, therefore, limited to those examples given.

Now referring to FIG. 25, in terms of the embodiment disclosed in Example IV, movement of the razor cartridge 12 toward the interior of the handle 16 causes the holder 198 to travel toward the interior of the handle 16. The movement of the holder 198 causes the attached linkage members 206,208 to travel relative to the handle 16 (i.e., travel through the channels 212,214). The travel of the linkage members 206, 208 in turn causes the base 200 and attached shaving aid body 14 to travel in a direction away from the interior of the handle 16; i.e., a direction substantially opposite the travel of the razor cartridge 12. As a result, the positions of the shaving aid body 14 and the razor cartridge 12 are continuously adjusted to maintain an approximately co-planar orientation during the useful life of the razor cartridge 12 and shaving aid body 14.

Now referring to FIGS. 26 and 27, in terms of the embodiment disclosed in Example V, movement of the razor cartridge 12 in a first direction, for example toward the interior of the handle 16, causes the holder 220 to travel in the same direction. The movement of the holder 220 causes the attached linkage members 228,230 to travel relative to the handle 16. The travel of the linkage members 228,230 in turn causes the base 222 and attached shaving aid body 14 to travel in a second direction opposite the first direction; e.g., away from the interior of the handle 16. As a result, the positions of the shaving aid body 14 and the razor cartridge 12 are continuously adjusted to maintain an approximately coplanar orientation during the useful life of the razor cartridge 12 and shaving aid body 14.

Referring to FIGS. 28-37, in terms of the embodiment disclosed in Example VI movement of the razor cartridge 12 in a first direction, for example toward the interior of the handle 16, causes the links 318 to pivot about the housing axles 324 received within the handle bearing mounts 326. The pivoting of the links 318 in turn causes the base 254 and attached shaving aid body 14 to travel in a second direction opposite the first direction; i.e., away from the internal cavity 17 of the handle 16. As a result, the contact surface 15 is maintained approximately co-planar with the cutting edges of the razor blades within the razor cartridge 12. In this manner, the positions of the shaving aid body 14 and the razor cartridge 12 are continuously adjusted to maintain the approximately coplanar orientation during the useful life of the replaceable cartridge 12.

Although this invention has been shown and described with respect to the detailed embodiments thereof, it will be understood by those skilled in the art that various changes in form and detail thereof may be made without departing from the spirit and scope of the invention.

What is claimed is:

1. A razor assembly, comprising:

a razor cartridge that includes one or more razor blades;

a shaving aid body;

a handle; and a linkage;

wherein the linkage is connected to the razor cartridge, the shaving aid body, and the handle in a manner such that the razor cartridge and the shaving aid body are moveable relative to the handle, and movement of one of the razor cartridge and the shaving aid body in a first direction causes the other of the razor cartridge and the shaving aid body to move in a second direction substantially opposite the first direction; wherein the shaving aid body is erodable, and the shaving aid body includes a contact surface, and wherein the linkage is actuable to maintain a predetermined orientation between the contact surface and the razor cartridge as the shaving aid body erodes.

2. The razor assembly of claim 1, wherein the linkage includes a linkage member that pivots about an axis.

3. The razor assembly of claim 1 wherein the handle includes an internal cavity and the linkage is disposed within the internal cavity.

4. The razor assembly of claim 1 wherein the linkage is indirectly connected to one or both of the razor cartridge and the shaving aid body.

5. The razor assembly of claim 4, further comprising a holder pivotally attached to the razor cartridge and connected to the linkage.

6. The razor assembly of claim 4, further comprising a base attached to the shaving aid body and connected to the linkage.

7. The razor assembly of claim 2, wherein the linkage member includes a first lobe and a second lobe, wherein the first lobe and the second lobe are disposed on opposite sides of the axis.

8. The razor assembly of claim 7, wherein the linkage member includes a plurality of first lobes disposed along the axis of the linkage member and a plurality of second lobes disposed along the axis of the linkage member.

9. The razor assembly of claim 7, wherein the linkage further comprises:

a first carriage connected to the shaving aid body and wherein the first lobe of the linkage member is received by the first carriage; and a second carriage connected to the razor cartridge and wherein the second lobe of the linkage member is received by the second carriage.

10. The razor assembly of claim 9, wherein the second carriage is slidably received within the first carriage.

11. The razor assembly of claim 2, wherein the linkage member includes at least one roller.

12. The razor assembly of claim 11, wherein the linkage further comprises: a first carriage connected to both the shaving aid body and the linkage member; and a second carriage connected to both the razor cartridge and the linkage member.

13. The razor assembly of claim 12, wherein:

the first carriage comprises at least one first rail for engagement with the roller; and the second carriage comprises at least one second rail for engaging the roller;

wherein the roller is disposed between and engaged with both the first rail and the second rail; and wherein rotation of the linkage member causes the roller to rotate relative to the first rail and the second rail.

14. The razor assembly of claim 11, wherein the second carriage is slidably received within the first carriage.

15. The razor assembly of claim 13, wherein the first rail and the second rail are both geared racks, and the roller is a geared roller sized to mesh with both the geared racks of the first rail and the second rail.

16. The razor assembly of claim 2, wherein the razor assembly further comprises: a width, a length, and a height; and wherein the axis extends in a lengthwise direction.

17. The razor assembly of claim 2, wherein the razor assembly further comprises: a width, a length, and a height; and wherein the axis extends in a widthwise direction.

* * * * *